US007337897B2

(12) United States Patent
Sutton-Rainey et al.

(10) Patent No.: US 7,337,897 B2
(45) Date of Patent: Mar. 4, 2008

(54) MULTI-USE CARRIER

(75) Inventors: Kim Sutton-Rainey, Seattle, WA (US); David M. Manthey, Kent, WA (US)

(73) Assignee: Kimada Packaging Inc., Kent, WA (US)

( * ) Notice: Subject to any disclaimer, the term of this patent is extended or adjusted under 35 U.S.C. 154(b) by 19 days.

(21) Appl. No.: 10/680,737

(22) Filed: Oct. 7, 2003

(65) Prior Publication Data

US 2004/0118707 A1 Jun. 24, 2004

Related U.S. Application Data

(60) Provisional application No. 60/461,250, filed on Apr. 7, 2003, provisional application No. 60/443,432, filed on Jan. 28, 2003, provisional application No. 60/417,405, filed on Oct. 8, 2002.

(51) Int. Cl.
*B65D 75/00* (2006.01)

(52) U.S. Cl. ..... 206/162; 206/174; 206/194; 206/198; 206/199

(58) Field of Classification Search ..... 206/162, 206/174, 194, 198–199, 217, 427, 549, 562, 206/563–564
See application file for complete search history.

(56) References Cited

U.S. PATENT DOCUMENTS 2,828,047 A * 3/1958 Weiselberg ..... 206/194
3,703,982 A * 11/1972 Daughtry ..... 206/563
4,156,484 A 5/1979 Winschusen
4,757,937 A * 7/1988 Maio et al. ..... 206/562
5,052,552 A 10/1991 Maroszek
5,609,379 A 3/1997 Harrelson
5,704,470 A 1/1998 Sutherland
5,743,389 A 4/1998 Cutler et al.
5,797,486 A * 8/1998 Picciolo ..... 206/194
5,803,264 A * 9/1998 Gersten et al. ..... 206/549
5,927,502 A 7/1999 Hunter
6,041,920 A 3/2000 Hart et al.
6,068,127 A 5/2000 Hunter
6,089,638 A 7/2000 Whitnell
6,202,836 B1 * 3/2001 Picciolo ..... 206/194
2002/0020653 A1 2/2002 Davis

* cited by examiner

*Primary Examiner*—Bryon P Gehman
(74) *Attorney, Agent, or Firm*—Black Lowe & Graham PLLC

(57) ABSTRACT

A single unit cardboard carrier is transformed from a collapsed state into an expanded multi-use carrier with a minimum of assembly actions. A preferred embodiment of the multi-use carrier has a central chamber, a plurality of vessel apertures located around the centered chamber, and has a handle spanning across the chamber.

20 Claims, 17 Drawing Sheets

MULTI-USE CARRIER

PRIORITY CLAIM

This application is a continuation of and claims priority to U.S. provisional patent application Ser. No. 60/461,250 filed Apr. 7, 2003. This application is also a continuation of and claims priority to U.S. provisional patent application Ser. No. 60/443,432 filed Jan. 28, 2003. This application is also a continuation of and claims priority to U.S. provisional patent application Ser. No. 60/417,405 filed Oct. 8, 2002. Each of the foregoing application is herein incorporated by reference in its entirety as if fully set forth herein. Specifications of the references are provided in Appendices A, B and C.

FIELD OF THE INVENTION

This invention relates generally to a portable food and beverage carrier and, more specifically, a food and beverage carrier configured so as to be capable of displaying advertising.

BACKGROUND OF THE INVENTION

Many food and beverage carriers used today include carriers the surface of which are unsuitable for affixing a printed advertising message. Many types of food and beverage carriers are based on paper products, predominantly corrugated cardboard. The corrugated cardboard type food and beverage carriers offer surfaces amenable to presenting a printed advertising message. Unfortunately, the corrugated paper based food and beverage carriers are multi unit constructed systems and present logistical problems in storing and assembling the carriers on-site for uses at sporting events as occur in stadiums, concerts, or other public venue areas. Besides presenting logistical difficulties in assembling the corrugated cardboard paper carriers, because of their multi unit construction, even when collapsed prior carriers increase the storage space required by local food vendors doing business at public venues.

There is a need to have a multiuse container having a handle, a plurality of panels of sufficiently large area to present printed advertising messages, and can be assembled from a minimum action assembly process. There is a need for a food and beverage container to be transformed from a collapsed or planar state with a minimum of manipulations to assemble into a three dimensional usable state. The need is also for the food and beverage carrier to have sufficient structural strength conferred by the handle to permit single hand carrying of food and beverages, especially when the food and beverages are asymmetrically loaded to create an unbalanced weight distribution. There is a need for a food and beverage carrier with a handle of sufficiently large panel size to be capable of presenting a printed advertising message. There is also a need for a food and beverage carrier to be easily disposable by incineration. There is yet another need for a carrier to function in the transporting of hazardous materials, in particular bio-hazardous materials such as with petri dishes and other microbial specimen containers. In this case, such advertising panels can be reconfigured to present printed hazardous waste warnings. Various embodiments of the instant invention address or can resolve one or more of the foregoing needs.

SUMMARY OF THE INVENTION

The instant invention is a multi-use carrier device that can be made from a single-die cut sheet of flexible materials, and that can be transformed or erected from a collapsed state into an expanded, carrier-ready state with a minimum of assembly actions. The optimal carrier ready state of the multi-use carrier can be determined by the toting duties of the preferred embodiments of the invention, such as toting supplies pertinent to and not limited by the food, beverage, gardening, janitorial, construction, microbiological, chemical, and nuclear industries. Depending on the toting duties of the multi-use carrier, the preferred embodiments of the invention include a plurality of surfaces to receive a plurality of printed messages and images concerning gardening, janitorial, construction, microbiological, chemical, nuclear, business coupons, and recreational board game subject matters. The flexible materials used in constructing the multi-use carrier can include paper-based materials, plastic-based materials, hybrid plastic-paper materials, and any other flexible yet semi-rigid materials. The paper-based materials can include corrugated cardboard that uses, but is not limited by, fluting grades A, B, C, E, F, and micro-fluting. The materials can also be amenable for incineration, or alternatively, recycling. The flexible materials used in the multi-use carrier can be capable of being configured so as to permit folding of carrier sections about a plurality of axes. Though made by flexible materials, the handle is securely affixed to the carrier, directly or by at least one internal wall, in turn, it is securely affixed to the carrier bottom, or by other means. The handle-internal wall-bottom securing arrangement can impart significant bridge-like stability to the multi-carrier and prevents buckling of the carrier under normal use conditions, and greatly aids the hand carrying of unbalanced loads.

The multi-use carrier comprises a plurality of preferred embodiments. Several preferred embodiments can be structurally stabilized by a handle that is flexibly affixed to the carrier bottom by at least one flexible reinforcing flange and is pivotable to permit transformation to the expanded state and secured by a plurality of walls substantially perpendicular to the handle having tabs that engage in slots to prevent inadvertent reversion to the collapsed state.

One Preferred Embodiment

The plurality of embodiments includes a first preferred embodiment having a central chamber surrounded by plurality of sub-chambers, each sub-chamber housing or itself constituting at least one aperture designed for specific toting tasks. The first preferred embodiment has a handle, at least two sides serving as a plurality of exterior walls along the carrier periphery, a bottom with a plurality of slots, a first-plurality of interior walls secured by flexible reinforcing flanges, and a second plurality of interior walls that secure to the bottom via a plurality of tabs that removeably engage with the plurality of slots of the carrier bottom. The first plurality of interior walls are extensions of the handle. The second plurality of interior walls are made from two affixed half-walls. The bottom, the interior of the middle portion of each side, and the second plurality of interior walls define the central chamber. Each extension of the first plurality of interior walls with the flexible reinforcing flanges supports the handle. The handle is made from two layers of corrugated cardboard and spans across the central chamber. The two sides and the center half-walls are hingeably retractable to transition from the collapsed state to the expanded, carrier-ready state. Creasing lines made by a plurality of linearly positioned perforations provides a hinging-like action that permits an easy and rapid bending of the carrier sides, walls, and horizontal surfaces.

A Second Preferred Embodiment

The plurality of embodiments further includes a second preferred embodiment having exterior walls with tab projections substantially perpendicular to the handle that engage with slotted bottoms, or alternatively, slotted horizontal surfaces, to prevent inadvertent reversion of the expanded carrier to the collapsed state.

Third and Fourth Preferred Embodiments

Alternate preferred embodiments of the invention include a food and beverage carrier and a microbiological carrier. The food and beverage carrier embodiment has at least one aperture of the plurality of apertures for carrying cups, cans, and other food and beverage items. The carrier sides and each side of the handle of the food and beverage carrier provides printable surfaces to display advertising messages and images, either printed directly onto the surface or affixed with printable labels. Similarly, the microbiological carrier can include a plurality of vessel apertures, each aperture able to be varied in size, shape, and number to accommodate the transport of microbe-containing vessels or microbiological related supplies. The carrier sides and each side of the handle of the microbiological carrier provides printable surfaces to display microbial information, biohazardous information, and disposal information of microbial containers and the microbiological carrier, including incineration. Yet, other preferred embodiments include the handle having a gripping aperture.

Collapsibility and Expansion

In some embodiments, the collapsed state of the multi-use carrier can be expanded to a carrier-ready state for toting supplies and returned to the collapsed state through pivotable action along the reinforcing flanges and along a plurality of crease lines. In some embodiments, the minimum of assembly steps required to transfer the multi-use carrier from its collapsed state to an expanded state ready-for-transport is approximately three assembly actions. The first assembly action is a first pivoting action along the flanges and crease lines, followed by two succeeding pivoting actions to tuck-in each tab into each slot. Each carrier can be returned to its collapsed state by reversing the assembly actions, that is, pulling each tab to un-tuck each tab from its engaged slot to initiate a collapsing action, followed by reversing the first pivoting action along the crease lines and flanges. An alternate embodiment has finger holes in the second plurality of interior walls to accommodate the placing of a finger to assist with the initial collapsing action. In still other embodiments, the collapsing and expanding can be accomplished with fewer actions, and in other ways.

The collapsed multi-use carrier can be stacked in the collapsed state for efficient storage. The collapsed carriers can be reused in their re-expanded state, or in the event of soiling or spillage of chemical, radiological, and biohazardous materials on the corrugated cardboard carriers, can be easily disposed of by incineration.

In some embodiments, the single-die cut sheet includes regions for receiving glue, staples, rivets, Velcro, or equivalent or any other fixing means to construct the handle and the flexible reinforcing flanges. In some embodiments, the single-die cut sheet further compromises one or more of the following features: cutouts for vessel apertures, slots, a gripping aperture, and a plurality of perforated or partially scored crease lines to serve as folding axes to prepare the collapsed state and to transform the collapsed state into the expanded state, and vice versa. Other preferred alternate embodiments include the multi-use carrier made from non-flexible panels comprised of materials configured to pivot about hinge-like structures. The nonflexible panels include rigid and thicker plastics, fiberglass, woods, hard pressed fiber papers, metals, or a hybrid of any of the preceding nonflexible materials. Instead of using perforations and partial scoring, hinges are connected between the sections of the multi-use carrier to make the necessary folding axes.

Another preferred alternate embodiment provides a pop-up tab for securing the bottom of the cup. The pop up tab for securing the cup may be of any shape. It may also be of any size, however in the preferred embodiment, the tab is small enough that the cutout from the base material is not so large that it unduly weakens the structural support for the cup. The tab may be perforated, scored, pinched or otherwise weakened or pre-disposed along its fold line to facilitate easier folding. Similarly, the fold line may be comprised of two fold lines, parallel but slightly offset, or slightly off parallel, or curved, or otherwise non-single-linear so that the fold up operation is more difficult, meeting with downward resistance (i.e., it wants to fold back down to its flat state) so as to apply more compressive pressure against the cup.

Some embodiments of the invention may utilize a single tab, or a plurality of tabs. For example, in some applications it maybe advantageous to have two tabs, oriented roughly 90 degrees apart in plan view, and opposite the corners formed by the exterior and interior walls of the carrier, so as to tend to press the cup into the corner formed by the junction of the interior and exterior walls. Where there is only a single tab, in the preferred embodiment it will generally be advantageous to place the tab directly opposite (in plan view) of the same corner, so as to apply compressive pressure against that corner to maximally stabilize the cup. There may also be tabs at separate positions relative to the corner to accommodate cups of different sizes, specifically, of different base diameters. Thus, for smaller cups, the tabs closer to the corner will be used, and for larger cups, the tabs farther from the corner will be used. In an alternate embodiment, the base of the cup (or other object) to be placed in the carrier can be adapted so as to fit with in the bottom of the carrier more securely. For example, the base of the cup can have inverse crenellations with corresponding notches in the bottom of the carrier so that the cup crenellations slip into the notches and thereby secure the cup to the bottom. Similarly, the crenellations can have a slope or notch in them such that after the base of the cup so placed in the notches, the cup can be twisted and locked into place. Similarly, in yet other embodiments, the bottom of the carrier can have apertures, preferably generally circular, of a diameter slightly larger than the diameter of the bottom of a tapered cylindrical cup, and yet slightly smaller than that of the diameter farther up the cup such that the base of the cup so secured similar to the manner in which the upper portion of the cup is secured by the apertures 42 in FIG. 1. In this embodiment, the bottom of the cup (or other container) may protrude beneath the bottom of the carrier, which may be advantageous in some situations.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
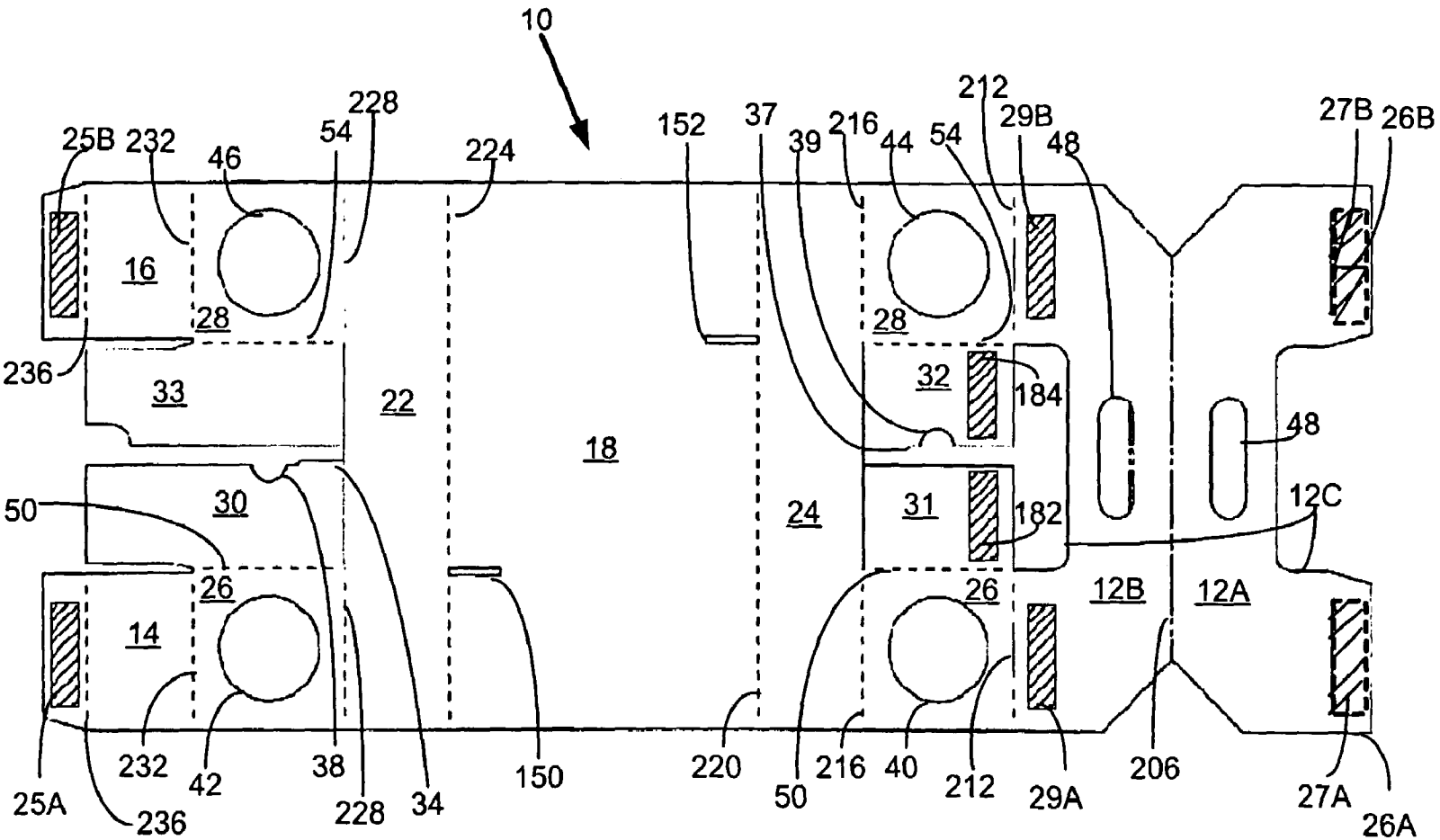
FIG. 1 is a top view of a single die-cut sheet of a food and beverage carrier embodiment.

FIG. 1 presents a top view of a single die-cut sheet 10 of a preferred food and beverage embodiment and provides a basis to explain the assembly of the collapsed embodiment of the food and beverage carrier. The single die-cut sheet food and beverage embodiment is a substantially rectangular cut, but may include other cuts that are substantially square, circular, and triangularly shaped. It is understood by those experienced in the art that the single die-cut sheet may be made from a multi-single die-cut sheeting machine configured to deliver more than one single die-cut sheet per manufacturing cycle.

The preferred single die-cut sheet 10 embodiment is made from paper-based, plastic-based, and hybrid paper and plastic-based materials. The paper-based products include non-corrugated cardboard and corrugated cardboard. The corrugated cardboard includes at least one of the fluting grades A, B, C, E, F, and micro-fluting. For example, the corrugated cardboard may include single grade (for example, A only, or C only), or any combination of single fluting grades. Combination grade examples would include B and E, or any combination that confers the necessary stability to meet the toting duties of the preferred embodiments of the multi-use carrier. The cardboard materials include craft, pre-print, white, and lithographic grade materials.

The plastic-based material includes plastic sheets and fiberglass reinforced plastics. The hybrid paper and plastic materials include cardboard, either corrugated on non-corrugated, embedded with plastic fibers, embedded with fiberglass, coated with plastic, and cardboard coated with fiberglass.

The single die-cut sheet 10 includes a plurality of sections, a plurality of foldable axes, a plurality of cutouts, and a plurality of affixing regions. The plurality of sections includes a first handle section 12A, a second handle section 12B, a first internal wall 14, a second internal wall 16, a bottom 18, a first horizontal surface 26, a second horizontal surface 28, a first side 22, a second side 24, a first internal half-wall 30, a second internal half-wall 31, a third internal half-wall 32, and a fourth internal half-wall 33. The first half-wall 30 has a first tab 34, and the third half-wall 32 has a second tab 37. The first handle section has a first extension 26A and a second extension 26B.

The plurality of foldable axes includes a first axis 50, a second axis 54, a third axis 206, a fourth axis 212, a fifth axis 216, a sixth axis 220, an seventh axis 224, a eighth axis 228, a ninth axis 232, and an tenth axis 236. The first axis 50 and the second axis 54 is substantially perpendicular to the third, fourth, fifth, sixth, seventh, eighth, ninth, and tenth, axes 206, 212, 216, 220, 224, 228, 232, and 236. Each axis of the plurality of axes serves as a plurality of crease lines to impart folding ability to each section by providing hinge-like pivoting action about each axis. The pivoting action is conferred to each axis by procedures compatible to the type of material the single die-cut sheet 10 is made. For example, linearly perforated lines or partially scored lines are applied to each axis, when the single die-cut sheet 10 is made from paper-based materials, such as corrugated cardboard.

The plurality of cutouts includes a plurality of vessel apertures, a plurality of finger holes, a gripping aperture 48 located on the first handle section 12A and the second handle section 12B, a handle arch 12C located on the first handle section 12A and the second handle section 12B, and a plurality of slots. The plurality of vessel apertures includes a first vessel aperture 40, a second vessel aperture 42, a third vessel aperture 44, and a fourth vessel aperture 46. An alternate embodiment of preferred embodiment 10 has each vessel aperture surrounded by a vessel collar (not shown) the perimeter of each first, second, third, and fourth vessel apertures 40, 42, 44, and 46. The vessel collar is a plurality of flaps that provide a squeezing action to cups or cans having variable sizes such that inserted cups or cans into each vessel aperture are prevented from extensive slippage. The plurality of finger holes include a first finger hole 38 located on the first half-wall 30, and a second finger hole 39 located on the third half-wall 32. The plurality of slots includes a first slot 150 located on the bottom 18 and adjacent to the seventh axis 224, and a second slot 152 located on the bottom 18 and adjacent to the sixth axis 220.

The first slot 150 is substantially diagonally separated from the second slot 152. The first slot 150 detachably receives the first tab 34 and the second slot 152 detachably receives the second tab 37 when the multi-use carrier is in its expanded state.

The plurality of affixing regions includes a first affixing region 25A located adjacent to the tenth axis 236 that is adjacent to the first internal wall 14; a second affixing region 25B located adjacent to the tenth axis 236 that is adjacent to the second internal wall 16; a third affixing region 27A located on the underside of the first extension 26A and is adjacent to the third axis 206 that is adjacent to the first handle section 12A; a fourth affixing region 27B located on the underside of the second extension 26B and is adjacent to the third axis 206 that is adjacent to the first handle section 12A, the third and fourth affixing regions 27A and 27B substantially linearly separated by the handle arch 12C; a fifth affixing region 29A located on the second handle section 12B adjacent to the fourth axis 212 that is next to the first horizontal surface 26; a sixth affixing region 29B located on the second handle section 12B adjacent to the fourth axis 212 that is next to the second horizontal surface 28; a seventh affixing region 182 located on second half-wall 31; and an eighth affixing region 184 located on the third half-wall 32.

The manufacture of the collapsed state of the multi-well carrier from the first single die-cut sheet 10 begins with application of affixing agents to the first, second, fifth, and sixth affixing regions 25A, 25B, 29A, and 29B. The affixing agents include glue, staples, rivets, brads, Velcro, or similar or equivalent or any other materials that can affix or join or secure surfaces together.

Figure 2:
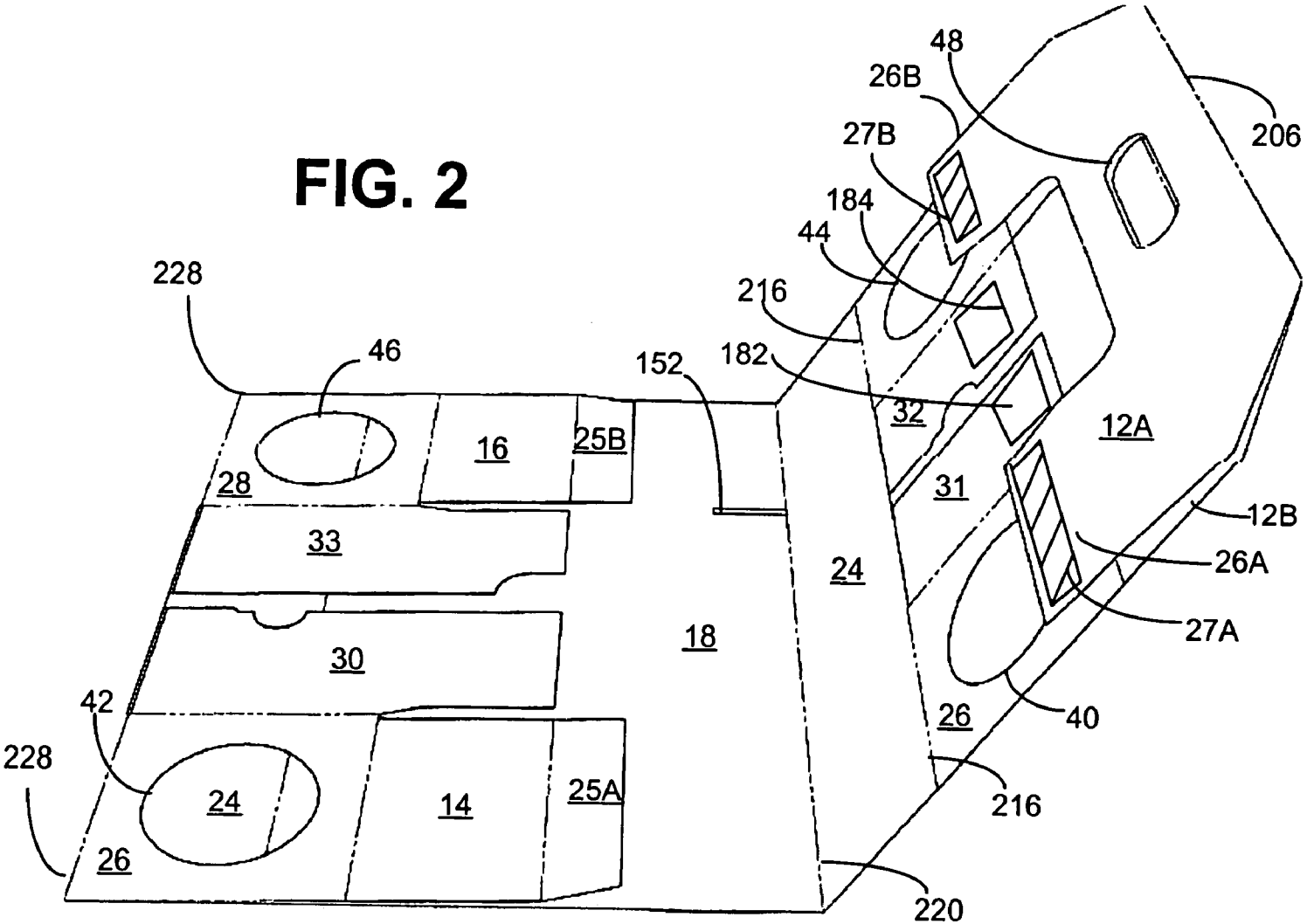
FIG. 2 is a perspective view of a single die-cut sheet food and beverage embodiment partially folded to the collapsed state.
Figure 3:
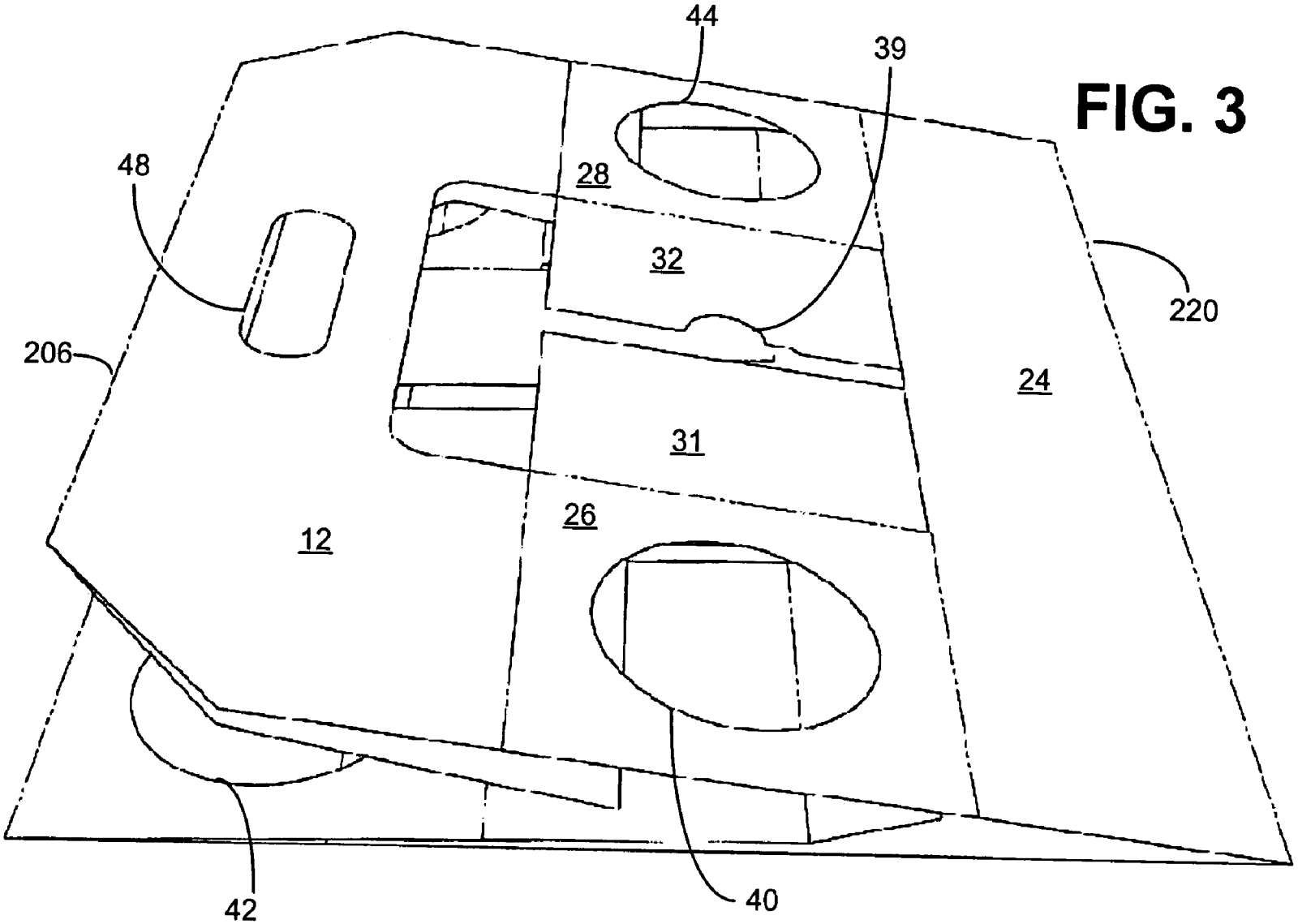
FIG. 3 is the single die-cut sheet food and beverage embodiment further progressing to the folded-collapsed state.
Figures 4A, 4B:
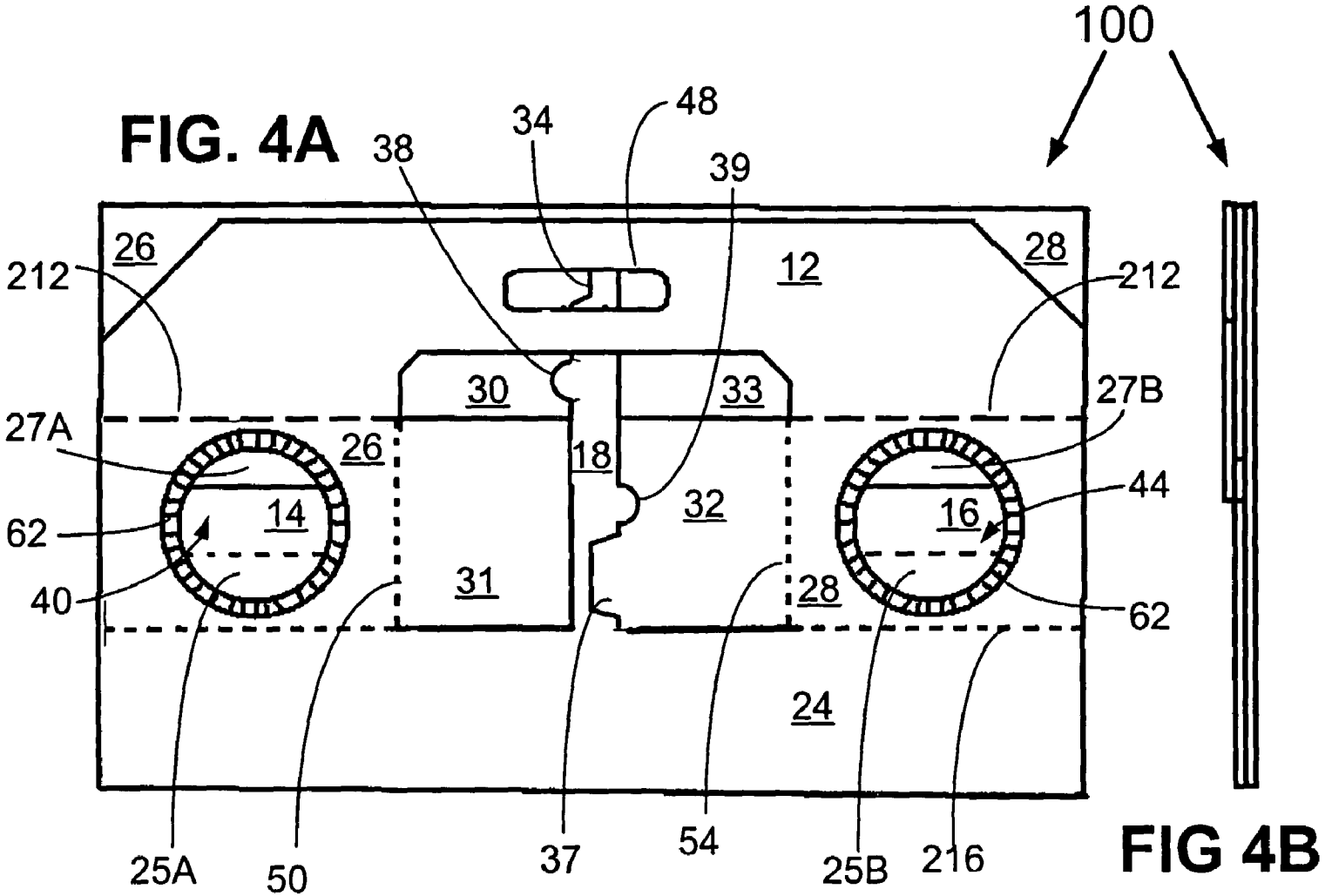
FIG. 4A is a top view of the collapsed food and beverage carrier embodiment.
FIG. 4B is a side view of the collapsed food and beverage carrier embodiment.

FIGS. 2 and 3 shows the food and beverage embodiment in a sequence of manufacturing steps through partially folded configuration approaching the collapsed state of the multi-use carrier depicted in FIGS. 4A and 4B. The first wall 14 and the second wall 16 are folded over to the bottom 18 about the eighth axis 228, carrying with it the first horizontal surface 26, the second vessel aperture 42, the first half-wall 30, the second horizontal surface 28, the fourth vessel aperture 46, the fourth half-wall 33, and the first and second affixing region 25A and 25B are affixed to the bottom 18. The first handle section 12A is folded over onto the second handle section 12B by pivoting about the fourth axis 206 with alignment of the gripping apertures 48, and the first handle section 12A is affixed to the second handle section 12B by pressing each handle section together to permit the fifth and sixth affixing regions 29A and 29B to affix each handle section. Glue is applied to the third, fourth, seventh, and eighth affixing regions 27A, 27B, 182, and 184 to prepare for the next construction step to make the collapsed state of the multi-use carrier. The now-affixed handle sections 12A and 12B form a handle 12. The second side 24 is pivoted about the fifth axis 220 and brings the third affixing region 27A in contact with the first internal wall 14, the fourth affixing region 27B in contact with the second internal wall 16, the seventh affixing region 182 of the second half-wall 31 in contact with the first half-wall 30, and the eighth affixing region 184 of the third half-wall 32 in contact with the fourth half-wall 33.

FIG. 3 is the food and beverage embodiment of the single die-cut sheet, almost completely folded to the collapsed state nearly equivalent to the collapsed state as depicted in FIGS. 4A and 4B. The third and fourth affixing regions 27A and 27B affix to the first wall 14 and the second wall 16, respectively. Similarly and substantially simultaneously, the second half-wall 31 is affixed to the first half-wall 30 by the sealing action of glue applied to the seventh affixing region 182. Similarly and substantially simultaneously, the third half-wall 32 is affixed to the fourth half-wall 33 by the sealing action of glue applied to the eighth affixing region 184.

FIG. 4A is a top view of the collapsed food and carrier embodiment 100. The handle 12 and the gripping aperture 48 are shown in geometric relationship to the first horizontal surface 26 and the second horizontal surface 28. Located centrally on the first horizontal surface 26 is the first vessel aperture 40. Substantially centrally located on the second horizontal surface 28 is the third vessel aperture 44. Continuous with the first surface 26 is the first half-wall 30 and the second half-wall 31 now affixed to the first half-wall 30. Visible within the first vessel aperture 40 is the first internal wall 14, the first affixing region 25A now functioning as a first reinforcing flange 25A, and the third affixing region 27A now functioning as a third reinforcing flange 27A. Visible within the third vessel aperture 44 is the second internal wall 16, the second affixing region 25B now functioning as a second reinforcing flange 25B, and the fourth affixing region 27B now functioning as a fourth reinforcing flange 27B. Visible about perimeter of the first vessel apertures 40 and the third vessel aperture 44 are the vessel collars 62, each vessel collar having the plurality of flaps cut substantially radially from the center of each aperture. The handle 12 is secured to the first internal wall 14 by the third reinforcing flange 27A and to the second internal wall 16 by the fourth reinforcing flange 27B. The first internal wall 14 is secured to the bottom 18 by the first reinforcing flange 25A. The second internal wall 16 is secured to the bottom 18 by the second reinforcing flange 25B. The handle 12 is pivotable about the fourth axis 212. The first horizontal surface 26 is pivotable about the fifth axis 216. The second horizontal surface is pivotable about the fifth axis 216. The fourth axis 212 is substantially parallel to the fifth axis 216.

The second half-wall 31 overlaps and is affixed to the first half-wall 30. Located on the interior edge of the first half-wall 30 is the first finger hole 38. Located on the interior edge of the first half-wall 30 is a first tab 34 that projects from the first half-wall 30. The first tab 34 is partially visible in the space defined by the gripping aperture 48. It is understood by those skilled in the art that the second half-wall 31 can overlap and be affixed to the first half-wall 30. Between the first horizontal surface 26 and the second half-wall 31 is the first axis 50. The first axis 50 continuously extends to and between the second half-wall 31 and the first horizontal surface 26. Substantially perpendicular to the first axis 50 is the fourth axis 212. Continuous with the second horizontal surface 28 is the third half-wall 32 and the fourth half-wall 33. The third half-wall 32 overlaps and is affixed to the fourth half-wall 33. Located on the interior edge of the third half-wall 32 is a second tab 37 that projects from the third half-wall 32. Located on the interior edge of the third half-wall 32 is the second finger hole 39. The second tab 37 is completely visible, as the handle 12 does not fold over the plane defining the first and second vessel apertures 40 and 44. The third half-wall 32 can overlap and be affixed to the fourth half-wall 33. Between the second horizontal surface 28 and the third half-Wall 32 is the second axis 54. The second axis 54 continuously extends to and between the fourth half-wall 33 and the second horizontal surface 28. Substantially perpendicular to the second axis 54 is the fourth axis 212. Substantial perpendicularity here, as elsewhere while generally preferred, is not required in all embodiments.

FIG. 4B is a side view of the collapsed food and carrier embodiment and shows a side view of the collapsed state of the invention 100. The collapsed state of the invention 100 is depicted folded in three layers.

Figure 5:
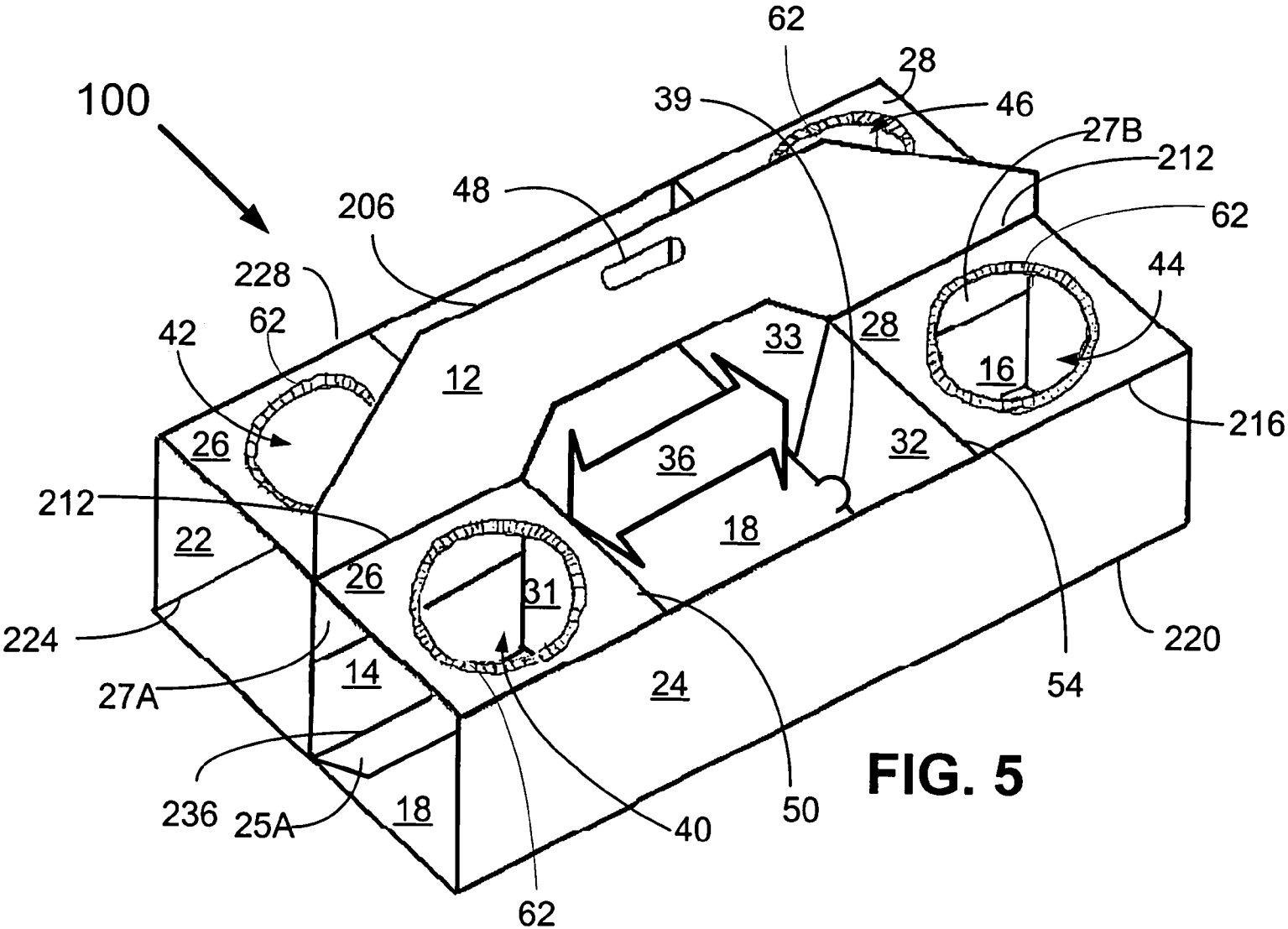
FIG. 5 is a perspective view of the expanded food and beverage carrier embodiment with single vessel apertures for each sub-chamber.

FIG. 5 is a perspective view of the expanded food and beverage carrier embodiment 100 with single vessel apertures for each sub-chamber. The handle 12 is pivoted substantially to a vertical position about the fourth axis 212 and is secured to the first internal wall 14 by the third reinforcing flange 27A and the second internal wall 16 by the fourth reinforcing flange 27B. The first internal wall 14 and the second internal wall 16 are secured to the bottom 18 by the first and second reinforcing flanges 25A (shown) and 25B (not shown), respectively. The first internal wall 14 and the second internal wall 16 pivots about the tenth axis 236. The expanded food and beverage carrier embodiment 100 is prevented to return to its collapsed state by insertion of the first tab 34 into the first slot 150 and the second tab 37 into the second slot 152 (all not shown). The first internal wall 14 and the second internal wall 16 function as a first plurality of interior walls.

The first side 22 is between the seventh axis 224 and the eighth axis 228. The second side 24 is between the fifth axis 216 and the sixth axis 220. The first side 22 functions as a first external wall and the second side 24 functions as a second external wall. Substantially parallel to the bottom 18 is the first horizontal surface 26 and the second horizontal surface 28. The first horizontal surface 26 and the second horizontal surface 28 is stabilized by the third and fourth reinforcing flanged 27A and 27B. Substantially perpendicular to the first horizontal surface 26 is the second half-wall 31. The second half-wall 31 is substantially perpendicular to and contacts the second side 24. In overlapping contact with the second half-wall 31 is the first half-wall 30 (not shown), the first half-wall 30 being affixed to the second half-wall 31. The first half-wall 30 is substantially perpendicular to and contacts the first side 22. Substantially perpendicular to the second horizontal surface 28 is the third half-wall 32. The third half-wall 32 is substantially perpendicular to and contacts the second side 24. In overlapping contact with the third half-wall 32 is the fourth half-wall 33, the fourth half-wall 33 being affixed to the third half-wall 32. The fourth half-wall 33 is substantially perpendicular to and contacts the first side 22. The first, second, third, and fourth half-walls 30, 31, 32, and 33 serve as a second plurality of interior walls. The first side 22 and the second side 24 serve as a plurality of exterior walls.

The fourth half-wall 32 has the second finger hole 39. A central chamber 36 depicted by the double arrow is defined by the bottom 18 and a central perimeter formed by the second plurality of interior walls, the middle section of the first side 22, and the middle section of the second side 24. The handle 12 spans across the central chamber 36 and is secured to the first plurality of interior walls. The first horizontal surface 26 has the first vessel aperture 40 and the second vessel aperture 42 substantially parallel to the second horizontal surface 28. The second horizontal surface 28 has the third vessel aperture 44 and the fourth vessel aperture 46. Each vessel aperture is shown substantially in a circular shape. Visible about perimeter of each vessel aperture are the vessel collars 62, each vessel collar having the plurality of flaps cut substantially radially from the center of each aperture. It is understood by those experienced in the art that the shape of each vessel aperture can vary to accommodate commonly used vessels and utensils. Moreover, each vessel aperture may not have vessel collars. Furthermore, each vessel aperture is not limited to a single shape but includes a plurality of shapes, including shapes that are substantially circular, ovals, square, diamond, and X-pattern shape. It is also understood by those experienced in the art that any combination of shapes can be distributed for each aperture. For example, the first vessel aperture 40 as depicted is circular, the second vessel aperture 42 is X-shaped, the third vessel aperture 44 is oval shaped, and the fourth vessel aperture 46 is square shaped. The handle 12 has a substantially elliptical gripping aperture 48 that is substantially centrally located in the handle 12 to permit single hand carrying of the expanded carrier 10. The surfaces of the first side 22, the second side 24, and on each side of the handle 12 provide surfaces to receive printed informational messages and images. Furthermore, the bottom 18 section within the central chamber 36, and the underside of the bottom 18 provides surfaces to receive printed informational messages and images.

In an alternate embodiment, further described below, bottom panel 18, which defines chamber 36 with panels 30, 31, 32 and 33 as shown in FIG. 5, may have a pop-up tab feature and an additional finger hole feature. To accommodate those alternate features, bottom 18 would be cut out. These cut-outs can be of different sizes, shapes and at different angles. These cut-outs can also have a single or plurality of crease fold lines adjacent to the cuts. The cut-outs provide the material for the pop-up tabs to provide additional restraint for extra cups should more than 4 cups be carried, or if cups are to be carried closer to the center and handle. The pop-up tabs from the cut out feature uses the spring-like effect of the material to provide pressure and secure the cups in place by pushing the cups against walls 224, 220 and the outer wall.

In yet other embodiments, finger holes are provided to ease the access, lifting and folding/unfolding of the carrier and/or the pop-up tabs.

Figure 6:
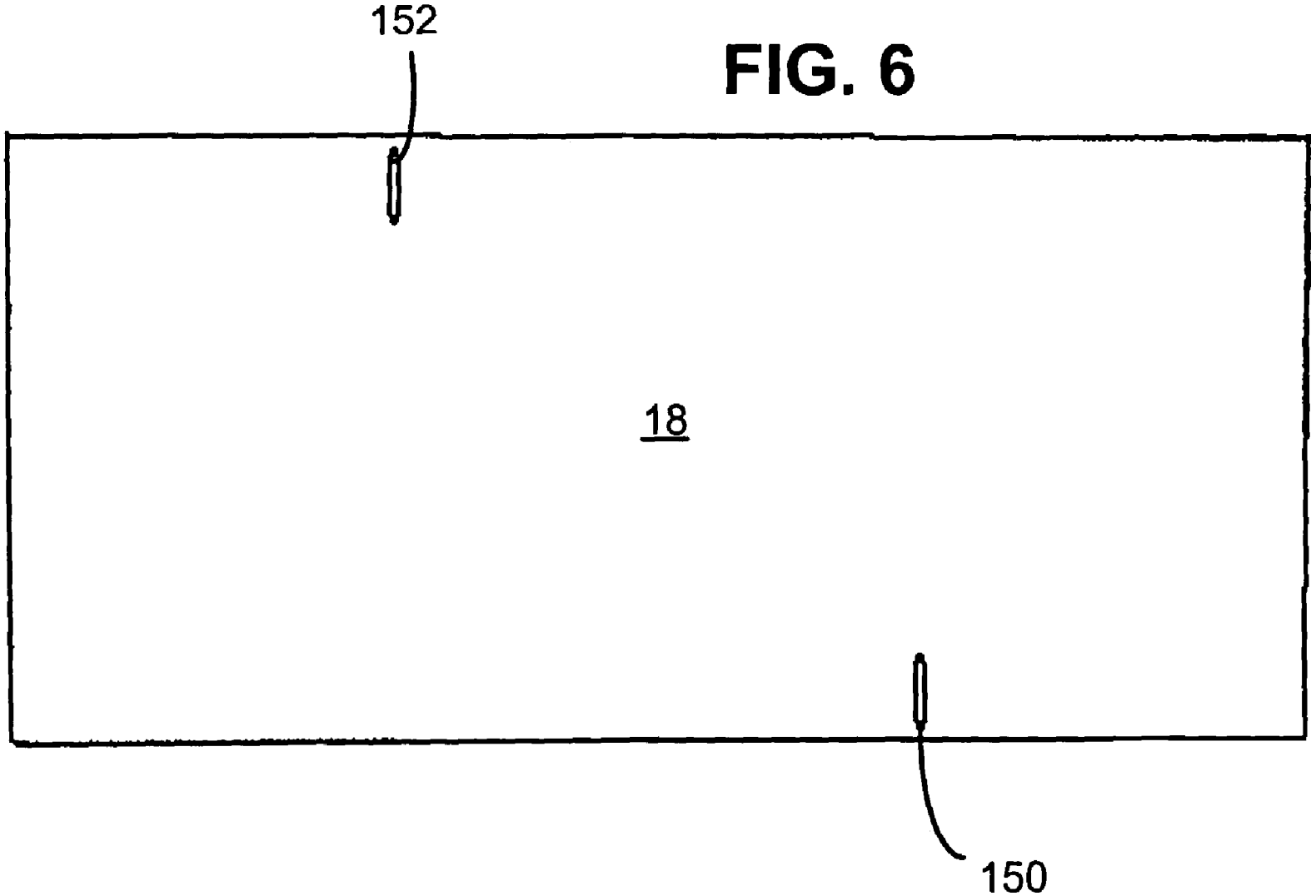
FIG. 6 is a top inside view of the carrier bottom showing slot locations for engaging tabs from interior walls.

FIG. 6 is a top inside view of the carrier bottom showing slot locations for engaging tabs from interior walls. The slot locations may vary in position and number to coincide with tab locations and tab numbers to permit the respective insertion of the tabs with each respective slot.

Figure 7:
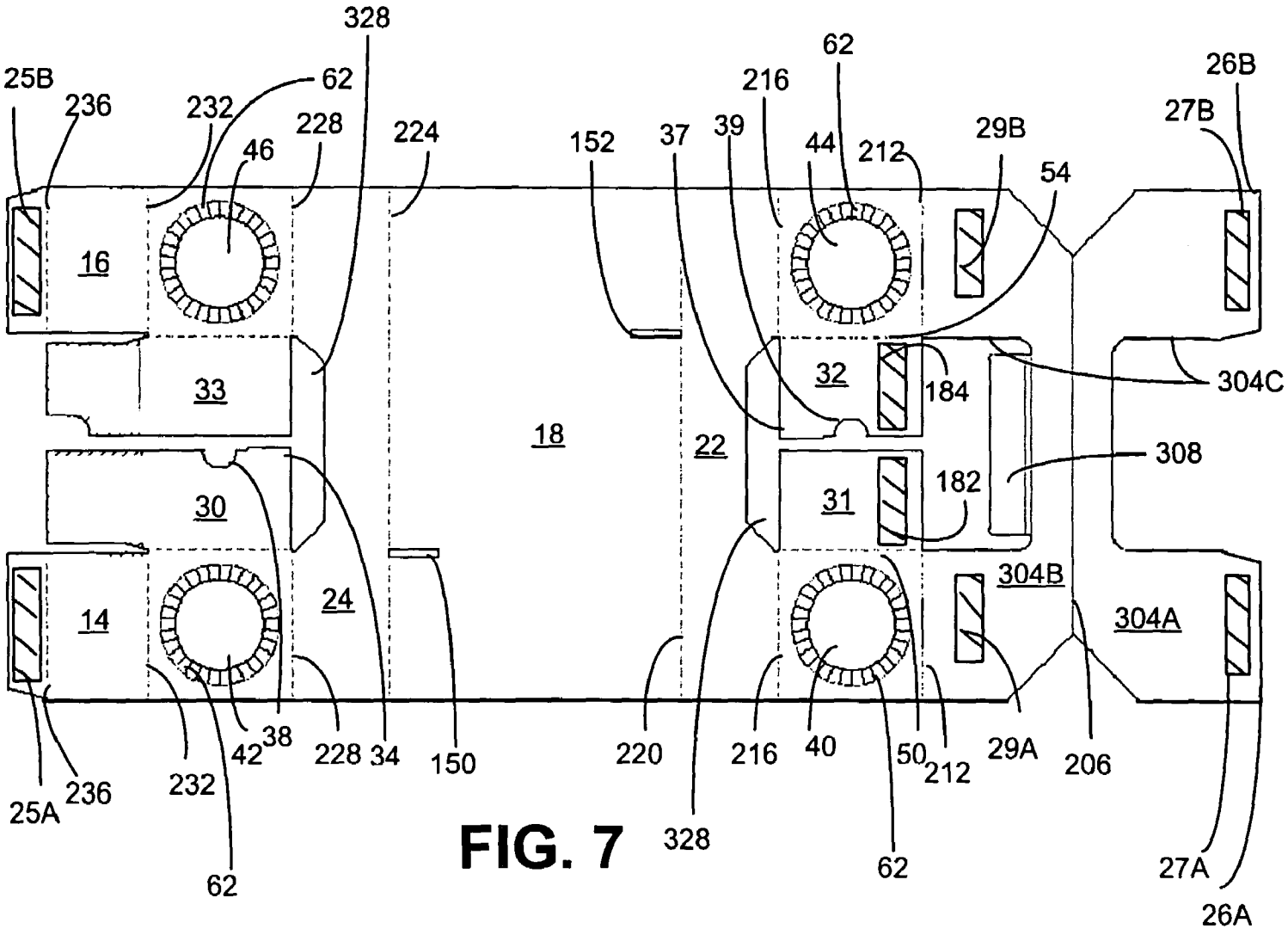
FIG. 7 is a preferred alternate embodiment of the single die-cut sheet of the food and beverage carrier.

FIG. 7 is a preferred alternate embodiment of the single die-cut sheet of the food and beverage carrier. Substantially similar to the food and beverage embodiment depicted in FIG. 1, the preferred alternate embodiment depicted in FIG. 7 has substantially similar components but differs in the shape of the handle and that the handle lacks the gripping aperture 48 of FIG. 1, in providing a handle cushion 308, and in providing a substantially trapezoidal cutout 328 in the central portions of the first and second sides 22 and 24. In particular, the handle is shown is split into two sections, a first section 304A and a second section 304B, each section lacking a gripping aperture. The two sections have a deeper square curvature 304C than the shorter square curvature 12C depicted in FIG. 1. Additionally, a handle cushion 308 is shown extending from the second section 304B. The first affixing region is 25A located on the end-extension of the first wall 14 and the second affixing region is 25B located on the end-extension of the second wall 16. The vessel collar 62 is shown along the perimeter of each first, second, third, and fourth vessel apertures 40, 42, 44, and 46. Each vessel collar 62, via the plurality of flaps provides a squeezing action to cups or cans having variable sizes such that inserted cups or cans into each vessel aperture are prevented from extensive slippage. The substantially trapezoidal cutout 328 in the first and second sides 22 and 24 confers to the central chamber 36 of the expanded carrier to have lower profile sidewalls from the middle regions of the first and second sides 22 and 24. Each lowered profile sidewalls permits larger sized or irregular shaped objects to be placed in and overhang from the central chamber 36 of the expanded carrier.

The first affixing region is 25A located on the end-extension of the first wall 14 and the second affixing region is 25B located on the end-extension of the second wall 16. Similarly, the third, fourth, fifth, sixth, seventh, and eighth affixing regions 27A, 27B, 29A, 29B, 182, and 184 are located in comparable regions as illustrated in FIG. 1. For example, the third and fourth affixing regions 27A and 27B of FIG. 7 are located on the underside surfaces of the first and second extensions 26A and 26B.

Figure 8:
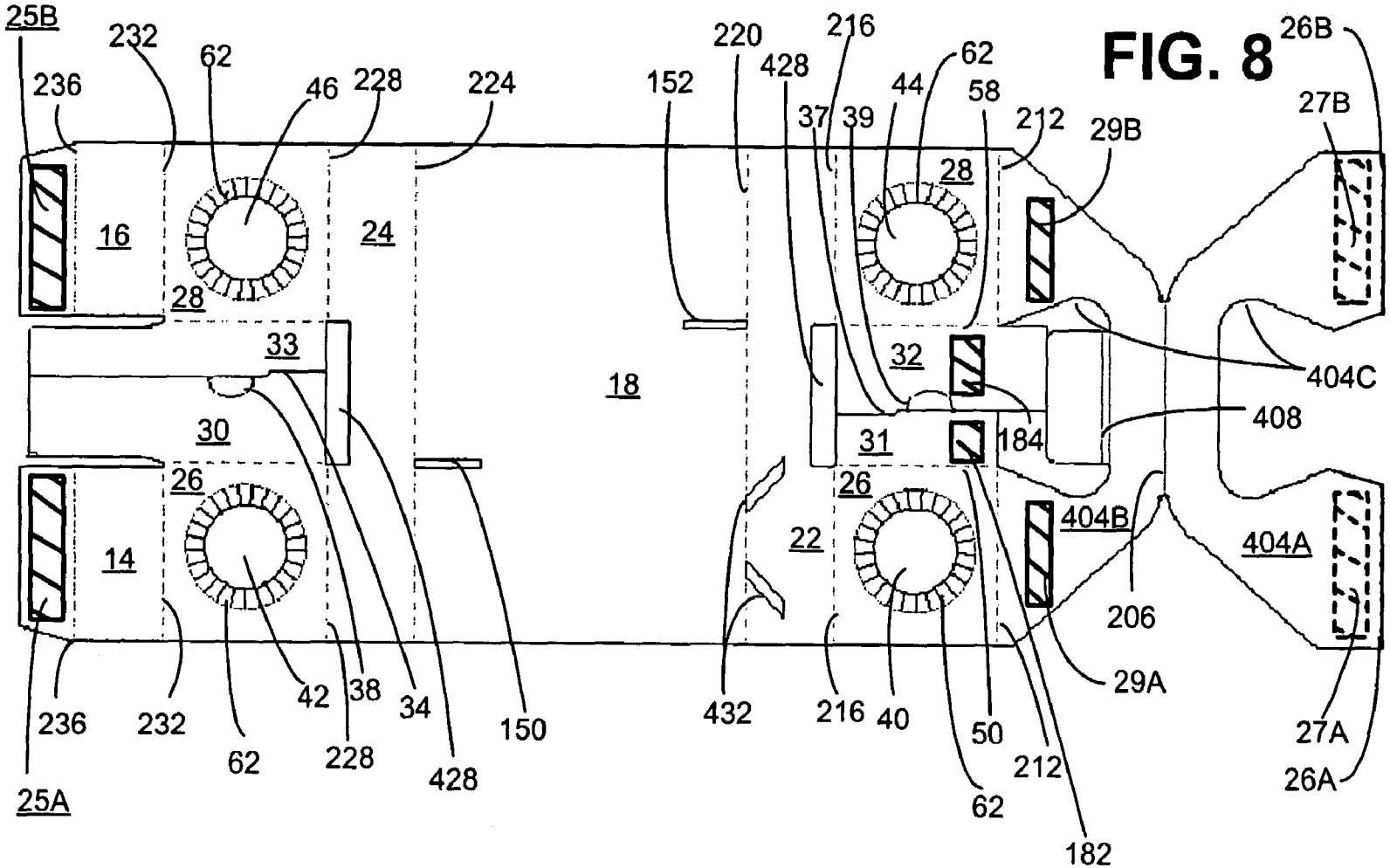
FIG. 8 is another preferred alternate embodiment of the single die-cut sheet of the food and beverage carrier.

FIG. 8 depicts another preferred alternate embodiment of the single die-cut sheet of the food and beverage carrier. Substantially similar to the food and beverage embodiment depicted in FIG. 1, the preferred alternate embodiment depicted in FIG. 8 has substantially the same components of FIG. 1 but differs in the shape of the handle, in providing a substantially rectangular cutout 428 in the central portions of the first and second sides 22 and 24, and in providing a space to receive a business card or similar card-like insert in the sides of the carrier. In particular, the handle is shown is split into two sections, a first section 404A and a second section 404B, each section lacking a gripping aperture. The two sections have a bowl-shaped curvature 404C instead of the shorter square curvature 12C depicted in FIG. 1. Additionally, a handle cushion 408 is shown extending from the second section 404B. The space to receive a business card is conferred to the preferred alternate embodiment by a slot-pair 432. Each slot of the slot-pair is positioned to receive and hold standard business cards. It is understood by those experienced in the art that more than one slot-pair can be present in the alternate embodiment, and the distance between each slot of the slot-pair may be varied to accommodate different size inserts.

The first affixing region is 25A located on the end-extension of the first wall 14 and the second affixing region is 25B located on the end-extension of the second wall 16. Similarly, the third, fourth, fifth, sixth, seventh, and eighth affixing regions 27A, 27B, 29A, 29B, 182, and 184 are located in comparable regions as illustrated in FIG. 1. For example, the third and fourth affixing regions 27A and 27B of FIG. 8 are located on the underside surfaces of the first and second extensions 26A and 26B.

The vessel collar 62 is shown along the perimeter of each first, second, third, and fourth vessel apertures 40, 42, 44, and 46. Each vessel collar 62, via the plurality of flaps provides a squeezing action to cups or cans having variable sizes such that inserted cups or cans into each vessel aperture are prevented from extensive slippage. The substantially rectangular cutout 428 in the first and second sides 22 and 24 confers to the central chamber 36 of the expanded carrier to have lower profile sidewalls from the middle regions of the first and second sides 22 and 24. Each lowered profile sidewalls permits larger sized or irregular shaped objects to be placed in and overhang from the central chamber 36 of the expanded carrier.

Figures 9A, 9B:
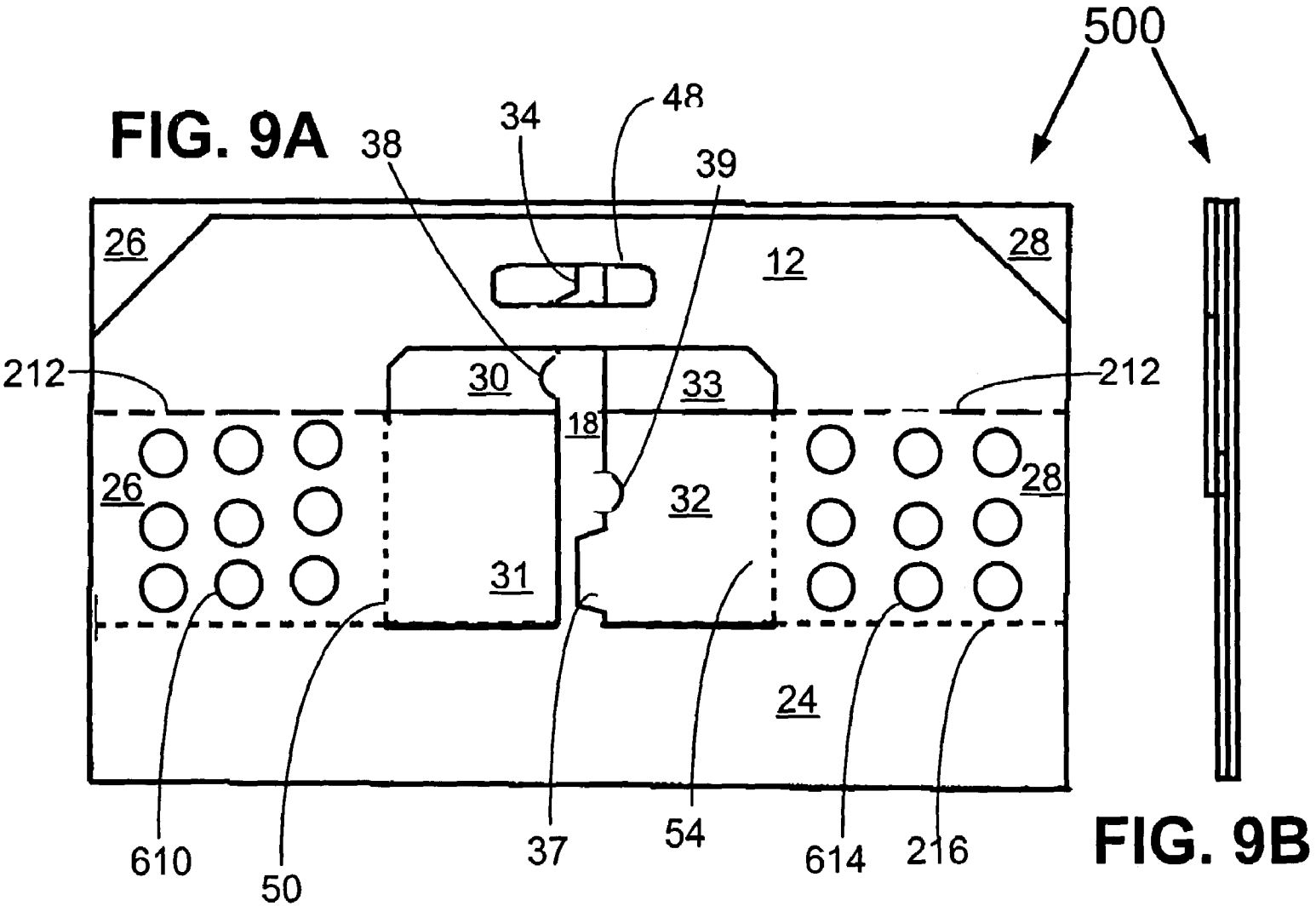
FIG. 9A is a top view of the collapsed microbiological carrier embodiment.
FIG. 9B is a side View of the collapsed microbiological carrier embodiment.

FIG. 9A is a top view of the collapsed state of the microbiological carrier 500. The microbiological embodiment 500 incorporates many of the same components as the food and beverage carrier 100. The handle 12 and the gripping aperture 48 are shown in geometric relationship to the first horizontal surface 26 and the second horizontal surface 28. Located centrally on the first horizontal surface 26 is the first plurality of microbial apertures 610. Substantially centrally located on the second horizontal surface 28 is the third plurality of microbial apertures 614. Continuous with the first surface 26 is the second half-wall 31 and the first half-wall 30. The second half-wall 31 overlaps and is affixed to the first half-wall 30. Located on the interior edge of the first half-wall 30 is a first finger hole 38. Located on the interior edge of the first half-wall 30 is a first tab 34 that projects from the first half-wall 30. The first tab 34 is partially visible in the space defined by the gripping aperture 48. It is understood by those skilled in the art that the second half-wall 31 can overlap and be affixed to the first half-wall 30. Between the first horizontal surface 26 and the second half-wall 31 is a first perforation axis 50. The first perforation axis 50 continuously extends to and between the first half-wall 30 and the first horizontal surface 26. Substantially perpendicular to the first perforation axis 50 is a second perforation axis 54. Continuous with the second horizontal surface 28 is the third half-wall 32 and the fourth half-wall 33. The third half-wall 32 overlaps and is affixed to the fourth half-wall 33. Located on the interior edge of the third half-wall 32 is the second tab 37 that projects from the third half-wall 32. Located on the interior edge of the third half-wall 32 is the second finger hole 39. The second tab 37 is completely visible as the handle 12 does riot fold over the plane defining first and third microbial apertures 610 and 614. It is understood by those skilled in the art that the third half-wall 32 can overlap and be affixed to the fourth half-wall 33. Between the second horizontal surface 28 and the third half-wall 32 is the second axis 54. The third perforation axis 54 continuously extends to and between the fourth half-wall 33 and the second horizontal surface 28. Substantially perpendicular to the second axis 54 is the fourth axis 212. The handle 12 pivots about the fourth axis 212. The microbiological embodiment 500 substantially operates with the same components as used by the food and beverage carrier embodiment 100.

FIG. 9B is a side view of the collapsed microbiological carrier embodiment and shows a side view of the collapsed state of the invention 500. The collapsed state of the invention 500 is depicted folded in three layers.

Figure 10:
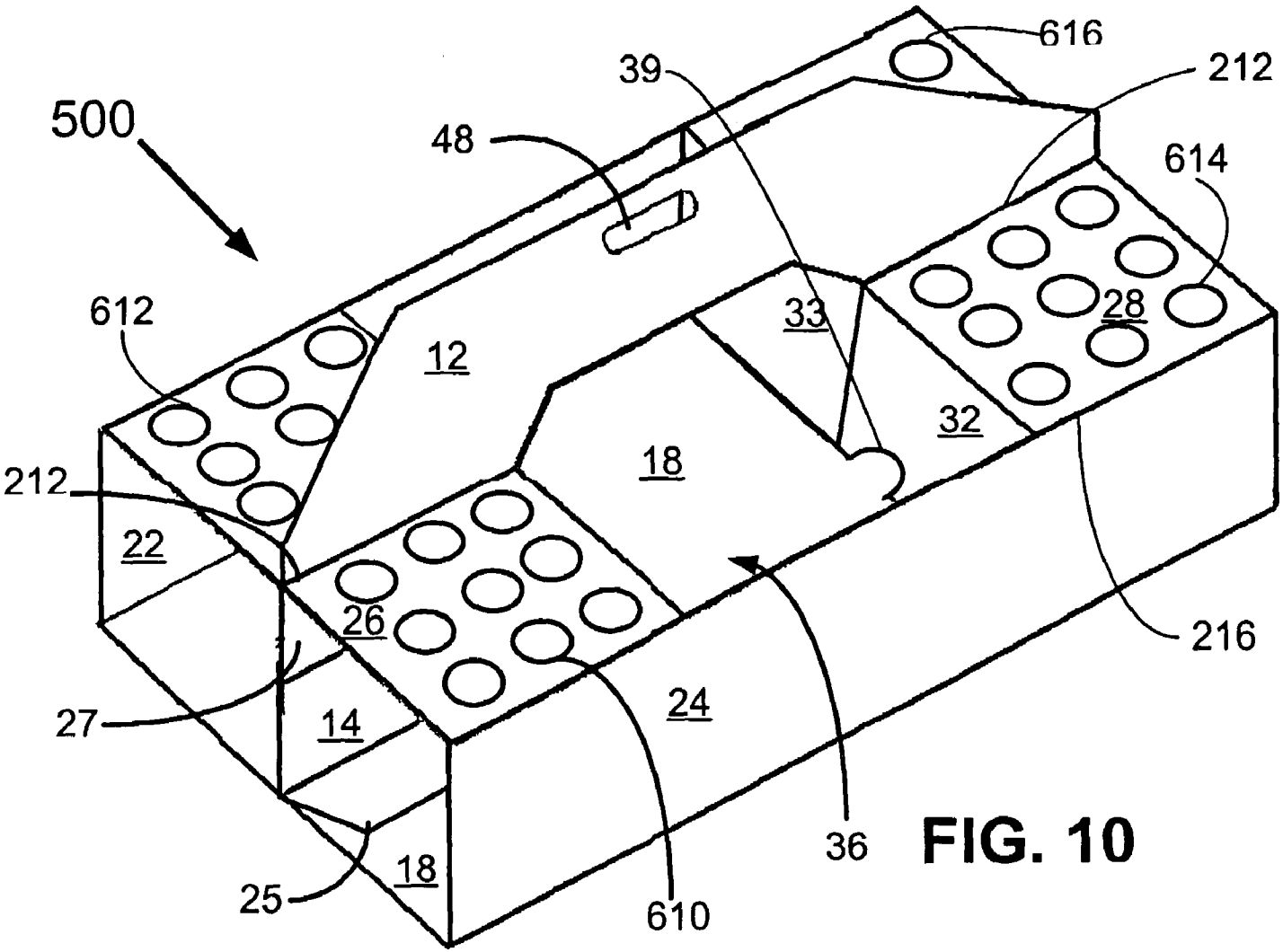
FIG. 10 is a perspective view of the expanded microbiological carrier embodiment with multiple vessel apertures for each sub-chamber.

FIG. 10 is a perspective view that shows another embodiment of the invention in the form of a microbiological carrier 500 in its expanded three-dimensional state. The microbiological embodiment 500 incorporates many of the same components as the food and beverage carrier 100. The handle 12 has the first internal wall 14 and the second internal wall 16 (not shown), fixed to the bottom 18 via the first reinforcing flange 25. Similarly, the second reinforcing flange 27 affixes the first horizontal surface 26 to the first internal wall 14 and the second horizontal surface 28 to the second internal wall 16 (not shown). Substantially parallel to the handle 12 is the first side 22 and the second side 24. Substantially parallel to the bottom 18 is the first horizontal surface 26 and the second horizontal surface 28. The first horizontal surface 26 and the second horizontal surface 28 is stabilized by the second reinforcing flange 27. Substantially perpendicular to the first horizontal surface 26 is the second half-wall 31. The second half-wall 31 is substantially perpendicular to and contacts the second side 24. In overlapping contact with the second half-wall 31 is the first half-wall 30, the first half-wall 30 being affixed to the second half-wall 31. The first half-wall 30 is substantially perpendicular to and contacts the first side 22. Substantially perpendicular to the second horizontal surface 28 is the third half-wall 32. The third half-wall 32 is substantially perpendicular to and contacts the second side 24. In overlapping contact with the third half-wall 32 is the fourth half-wall 33, the fourth half-wall 33 being affixed to the third half-wall 32. The fourth half-wall, 33 is substantially perpendicular to and contacts the first side 22. The third half-wall 32 has the second finger hole 39. A central chamber 36 is defined by the bottom 18 and the central perimeter formed by first half-wall 30, the second half-wall 31, the third half-wall 32, the fourth half-wall 33, the middle section of the first side 22, and the middle section of the second side 24. The handle 12 spans across the central chamber 36 and is attached by the first horizontal surface 26 and the second horizontal surface 28 at substantially perpendicular orientations. The first horizontal-surface 26 has the first plurality of microbial apertures 610 and a second plurality of microbial apertures 612. The second horizontal surface 28 has the third plurality of microbial apertures 614 and a fourth plurality of microbial apertures 616. Each plurality of microbial apertures is shown with a set of nine apertures of substantially equal sizes. It is understood by those experienced in the art that the number of apertures may vary, and the sizes of the apertures may vary within each plurality of microbial apertures to accommodate different sized microbial containers. The handle 12 has the substantially elliptical gripping aperture 48 that is substantially centrally located in the handle to permit single hand carrying of the expanded microbiological carrier 500. The panels on the first side 22, the second side 24, and on each side of the handle 12 provide surfaces to receive printed messages concerning biohazardous materials. Furthermore, the bottom 18 section within the central chamber 36, and the underside of the bottom 18 provides surfaces to receive printed messages concerning biohazardous materials. The biohazardous messages include microbiological information including handling procedures, warnings, and directions for disposal of the microbiological carrier 500, including incineration.

Figure 11:
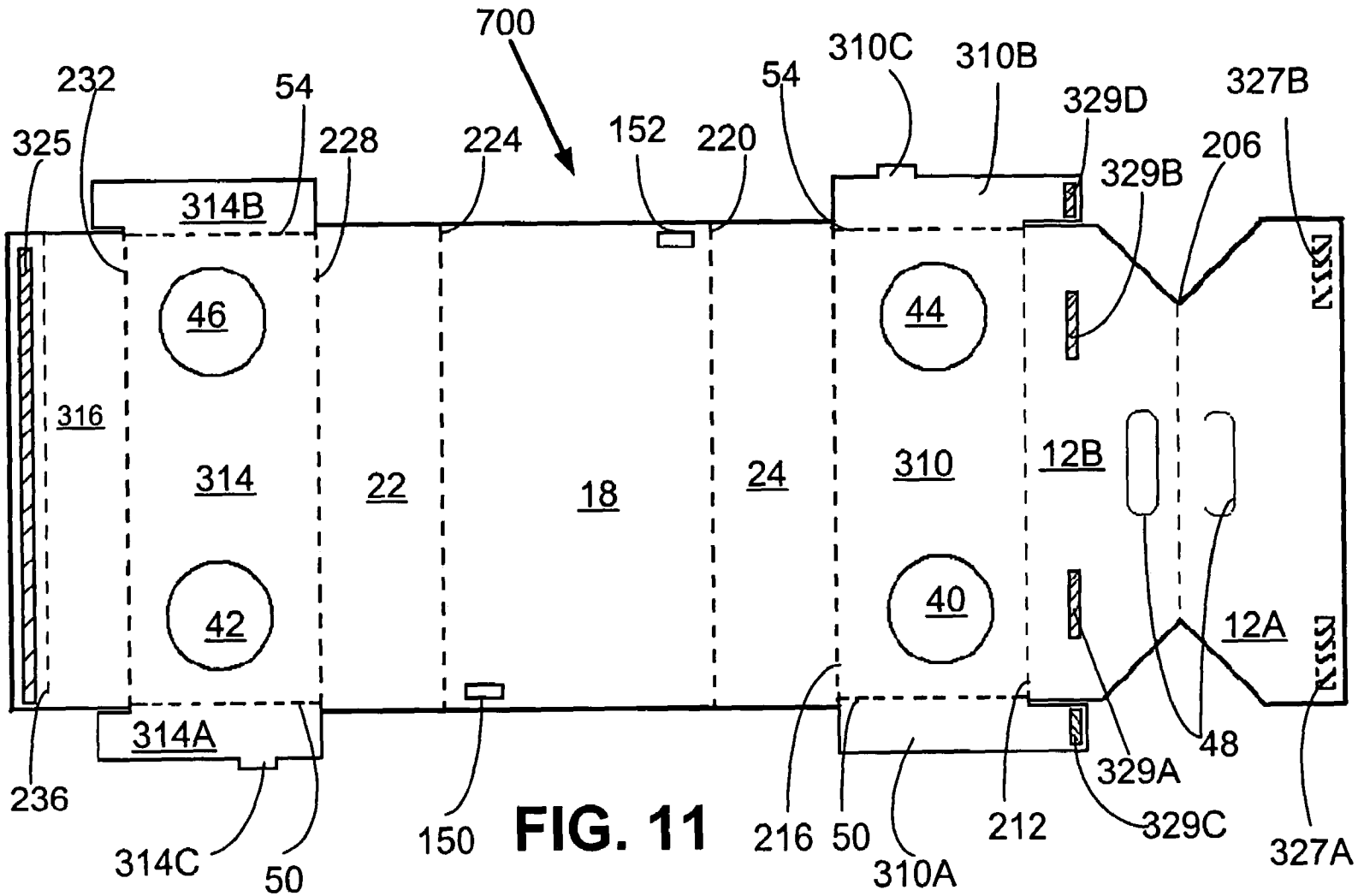
FIG. 11 is a top view of a single die-cut sheet of an alternate preferred embodiment of the food and beverage carrier embodiment having external side flaps that lock to the carrier bottom.

FIG. 11 is a top view of an alternate preferred single die-cut sheet of the food and beverage carrier embodiment 700 having external walls or side flaps that engage to the carrier bottom's 18 first slot 150 and the second slot 152 that is substantially diagonally opposite the first slot 150. The preferred embodiment 700 has a first horizontal surface 310 and a second horizontal surface 314. The first horizontal surface 310 houses the first and third vessel apertures 40 and 44. The second horizontal surface 314 houses the second and fourth vessel apertures 42 and 46. Each vessel aperture as illustrated in FIG. 11 does not have the aperture collars 62 as illustrated in FIGS. 4A, 5, 7, and 8. Alternate embodiments of the preferred embodiment 700 have the aperture collars 62 as illustrated in FIGS. 4A, 5, 7, and 8. Substantially similar to the preferred single die-cut sheet embodiment 10 of FIG. 1, the preferred embodiment 700 has many of the same components (the first through the tenth axes 50, 54, 206, 212, 216, 220, 224, 228, 232, 236; the first side or first external wall 22; the second side or second external wall 24; the gripping aperture 48, for example).

Extending from the first horizontal surface 310 is a first external half-wall 310A and a second external half-wall 310B. Projecting from the second half-wall 310B is a first tab 310C. Extending from the second horizontal surface 314 is a third external half-wall 314A and a fourth external half-wall 314B. Projecting from the third external half-wall 314A is a second tab 314C. Extending from the second horizontal surface 314 across from the ninth axis 232 is an internal wall 316.

The preferred embodiment 700 has seven affixing regions instead of eight affixing regions described in FIGS. 1, 7, and 8. The seven affixing regions that includes a first affixing region 325 extending from the internal wall 316 across from the tenth axis 236, a second affixing region 327A, a third affixing region 327B, a fourth affixing region 329A, a fifth affixing region 329B, a sixth affixing region 329C, and a seventh affixing region 329D. The second and third affixing regions 327A and 327B are on the underside and approximately close to the end of the first handle section 12A. The fourth and fifth affixing regions 329A and 329B are located on the second handle section 12B. The sixth affixing region 329C is located on the first external half-wall 310A. The seventh affixing region 329D is located on the second external half-wall 310B. Other alternate embodiments of the preferred embodiment 700 include six affixing regions such that the second and third affixing regions 327A and 327B are effectively merged together to form a single affixing region substantially similar to the first affixing region 325.

Figure 12:
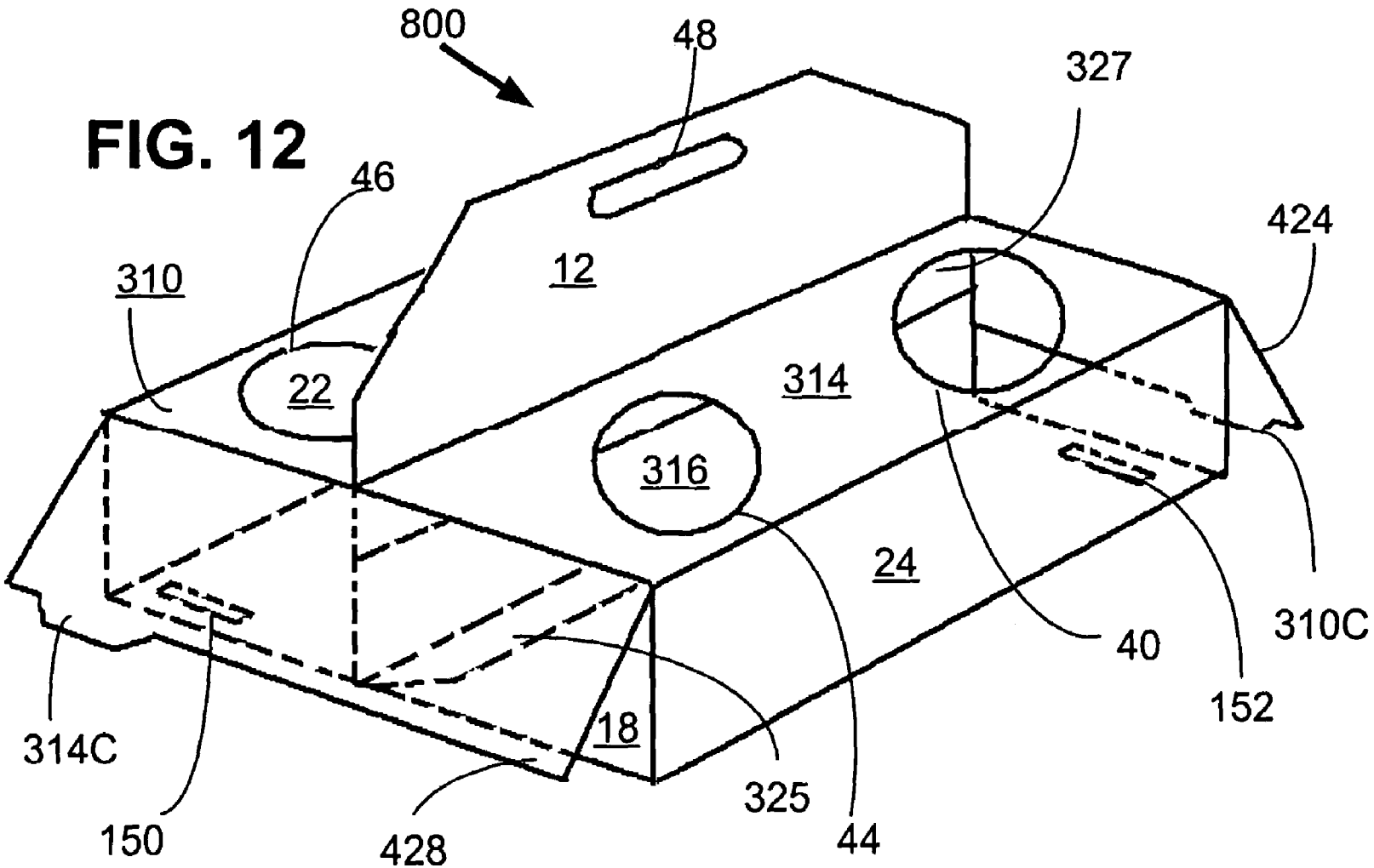
FIG. 12 is a perspective view of the expanded the food and beverage carrier alternate preferred embodiment having external side flaps that lock to the carrier bottom.

The collapsed state of alternate embodiment 700 is made in a manner substantially equivalent to expanded embodiment 800 illustrated in FIG. 12. Affixing the second external half-wall 310B to the fourth external half-wall 314B makes a third external wall 424. The third external wall 424 includes the first tab 310C extending from it. Affixing the first external half-wall 310A to the third external half-wall 314A makes a fourth external wall 428. The fourth external wall 428 includes the second tab 314C extending from it.

FIG. 12 is a perspective view of a preferred expanded the food and beverage carrier embodiment 800 having external walls or side flaps that lock to the carrier bottom. The expanded state is prevented from reverting back to the collapsed state by insertion of the first tab 310C extending from the third wall 424 into the second slot 152 and by insertion of the second tab 314C extending from fourth wall 428 into the first slot 150. The second horizontal surface 314 includes the first vessel aperture 40 and the third vessel aperture 44. Through the third vessel aperture 44 the internal wall 316 is visible and is secured to the bottom 18 via the first reinforcing flange 325. Similarly, the handle 12 is secured to the internal wall 316 via the second reinforcing flange 327. The gripping aperture 48 is centrally located on the handle 12. Through the fourth aperture 46 located on the second horizontal surface 310 the first side 22 is visible. The third and fourth external walls 424 and 428 are substantially perpendicular to the first and second sides 22 and 24.

Figure 13:
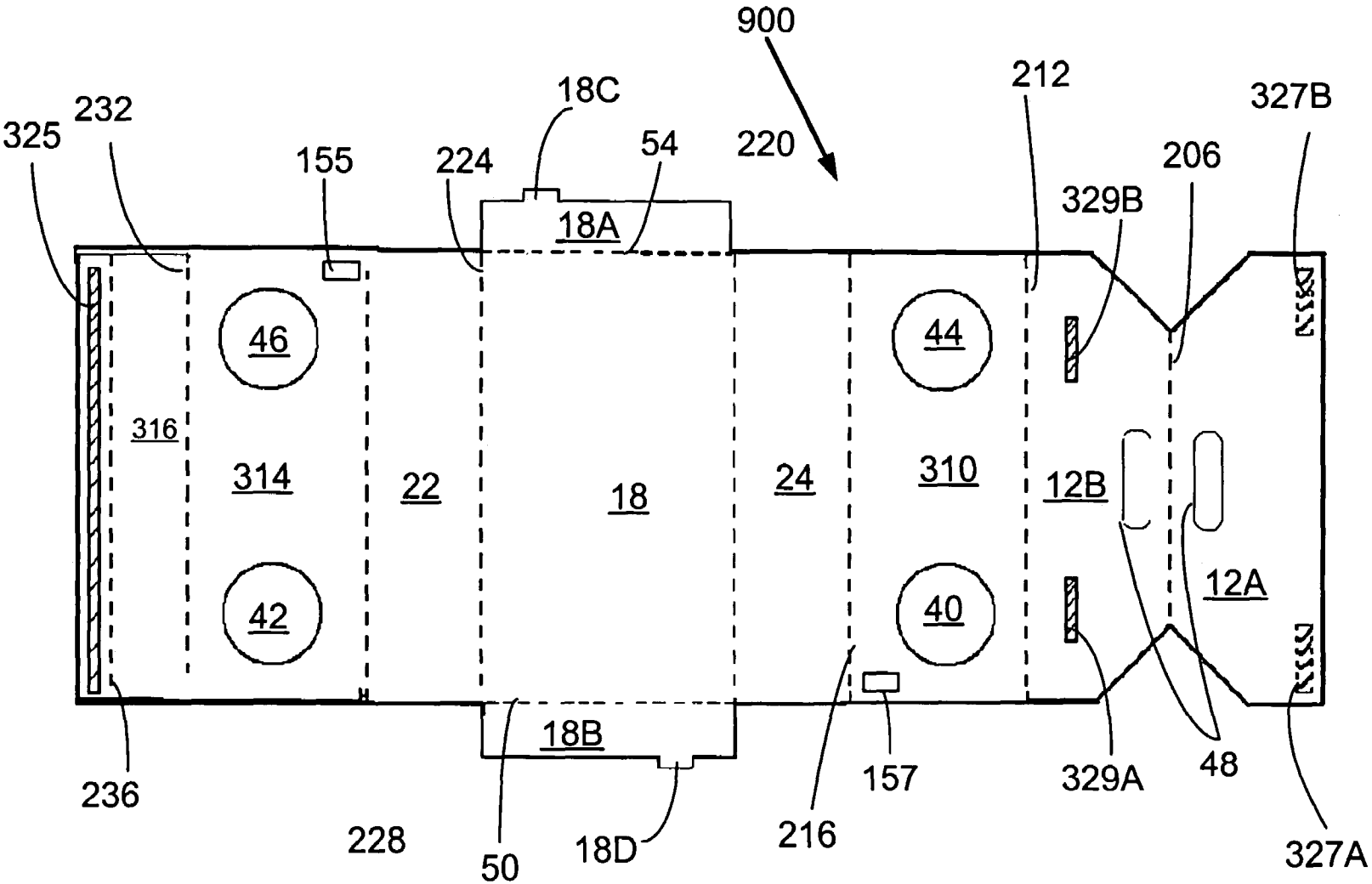
FIG. 13 is a top view of a single die-cut sheet of the food and beverage carrier embodiment having external side flaps that lock to the carrier horizontal surfaces.

FIG. 13 is a top view of a preferred single die-cut sheet of the food and beverage carrier embodiment 900 having external walls or side flaps that lock to the carrier horizontal surfaces. Substantially similar to the preferred single die-cut sheet embodiment 10 of FIG. 1 and the preferred single die-cut sheet embodiment 700 of FIG. 11, the preferred embodiment 900 has many of the same components (the first-tenth axes, gripping aperture 48, the internal wall 316, the first horizontal surface 310, the second horizontal surface 314, for example) and does not illustrate the aperture collars 62 of FIGS. 4A, 5, 7, and 8. Alternate embodiments of the preferred embodiment 700 have the aperture collars 62 as illustrated in FIGS. 4A, 5, 7, and 8.

The preferred embodiment 900 has five affixing regions substantially similar to the preferred embodiment 700 of FIG. 11. The second and third affixing regions 327A and 327B are on the underside of first handle section 12A. Similarly, the fourth and fifth affixing regions 329A and 329B are on the second handle section 12B. The preferred embodiment 900 has a first slot 155 on the first horizontal surface 314, and a second slot 157 on the first horizontal surface 310. The first horizontal surface 310 includes the first vessel aperture 40 and the third vessel aperture 44. The second horizontal surface 314 includes the second vessel aperture 42 and the fourth vessel aperture 46. Extending from the second horizontal surface 314 is the interior wall 316. Adjacent to interior wall 316 is across from the tenth axis 236 is a first affixing region 325. The first affixing region 325 is continuous and when juxtaposed to the bottom 18, forms a first reinforcing flange 325 in the expanded carrier illustrated in FIG. 14. The second and third affixing regions 327A and 327B are substantially separated near the end of the first handle section 12A. The second and third affixing regions 327A and 327B when juxtaposed to the internal wall 316, forms a second reinforcing flange 327 in the expanded carrier illustrated in FIG. 14.

FIG. 13 illustrates four vessel apertures, with two vessel apertures for each horizontal surface. Alternate embodiments of preferred embodiment 900 may have one vessel aperture for each horizontal surface, or greater than two vessel apertures for each horizontal surface. Yet other alternate embodiments include four affixing regions such that the second and third affixing regions 327A and 327B are effectively merged together substantially similar to the first affixing region 325.

Unlike the preferred embodiments depicted in FIGS. 1, 6, 8, 11, and 12, the bottom 18 does not have slots. Extending from the bottom 18 is a first bottom extension 18A and a second bottom extension 18B. A first tab 18C projects from the first bottom extension 18A and a second tab 18D projects from the second bottom extension 18B. The first tab 18C is detachably received into the first slot 155 and the second tab 18D is detachable received into the second slot 157 for the expanded carrier illustrated in FIG. 14.

Figure 14:
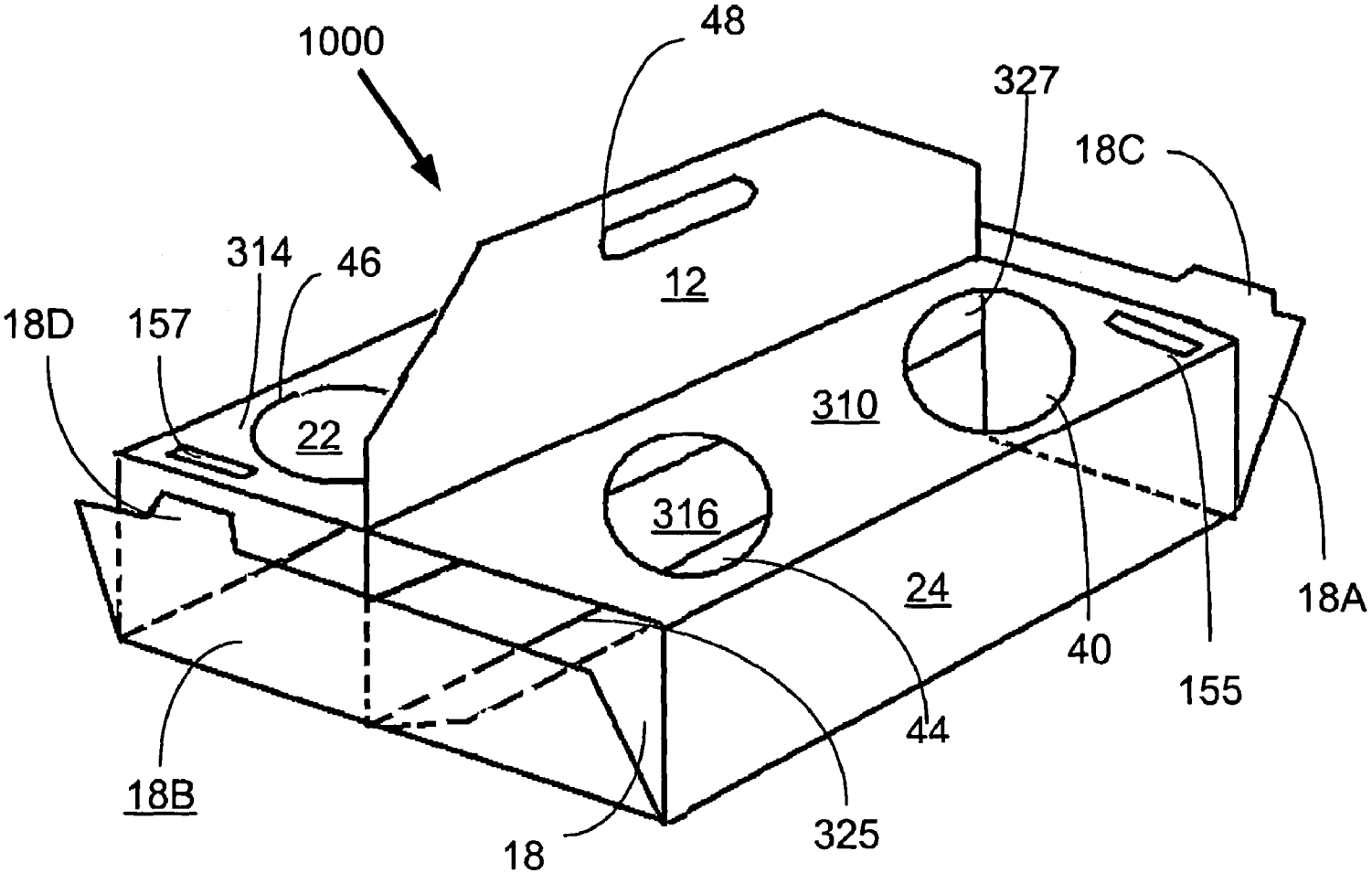
FIG. 14 is a perspective view of the expanded food and beverage carrier alternate preferred embodiment having external side flaps that lock to the carrier horizontal surfaces.

FIG. 14 is a perspective view of the expanded food and beverage carrier preferred embodiment 1000 having external walls or side flaps that lock to the carrier horizontal surfaces. The expanded embodiment 1000 is derived from a collapsed carrier state made from the preferred single die-cut embodiment 900 in a manner substantially similar to the collapsed carrier embodiment 100 of FIG. 4A. The expanded carrier embodiment 1000 is secured by pivoting the first bottom extension 18A so that insertion of the first tab 18C into the first slot 155 occurs, and the pivoting the second bottom extension 18B so that insertion of the second tab 18D into the second slot 157 occurs. The first extension 18A and the second extension 18B function as a third and a fourth external walls that are substantially perpendicular to the first and second sides 22 and 24. The second horizontal surface 310 includes the first vessel aperture 40 and the third vessel aperture 44. Through the third vessel aperture 44 the internal wall 316 is visible and is secured to the bottom 18 via the first reinforcing-flange 325. Similarly, the handle 12 is secured to the internal wall 316 via the second reinforcing flange 327 as seen through the first vessel aperture 40. Through the fourth aperture 46 located on the second horizontal surface 314 the first side 22 is visible.

While the preferred embodiment of the invention has been illustrated and described, as noted above, many changes can be made without departing from the spirit and scope of the invention. For example, the preferred embodiments using the external side flaps using the tabs to hook to the bottom slots or to the slots of the horizontal surfaces may be combined in hybrid form so that one side flap hooks to the bottom, and the other side flap hooks to the horizontal surface. Similarly, the preferred embodiments using the second plurality of internal wall using tabs to insert into the bottom slots may be designed to insert into slots cut into the horizontal surfaces, or alternatively, one tab inserts into a bottom slot and another tab inserts into a slot cut into a horizontal surface. Additionally, the die-cut sheets include widths of approximately 10 to approximately 16 inches, and lengths of approximately 25 inches to 40 inches. The heights of the expanded carriers can vary between approximately 1 inch to approximately 4 inches. Other dimensions for the width, length, and height of each collapsed and expanded multi-use carrier embodiment may vary to meet the required toting duties. For example, single die-cut sheet sheets of approximately 31¼ by 11³⁄₁₆ inches will render an expanded carrier having dimensions of approximately 11⅛ inches long, 7½ inches wide, approximately 2⅛ inches high as determined by the height of the external walls, and includes the central chamber having a length of approximately 7⅛ inches, a width of approximately 3⅛ inches, and a height of approximately 2 inches as determined by the height of the internal walls. Similarly, single die-cut sheet of approximately 38½ by 15½ inches will render an expanded carrier having dimensions of approximately 15½ inches long, 9 inches wide, approximately 2⅛ inches high as determined by the height of the external walls, and includes the central chamber having a length of approximately 8⅝ inches, a width of approximately 6½ inches, and a height of approximately 2 inches as determined by the height of the internal walls.

Figure 15:
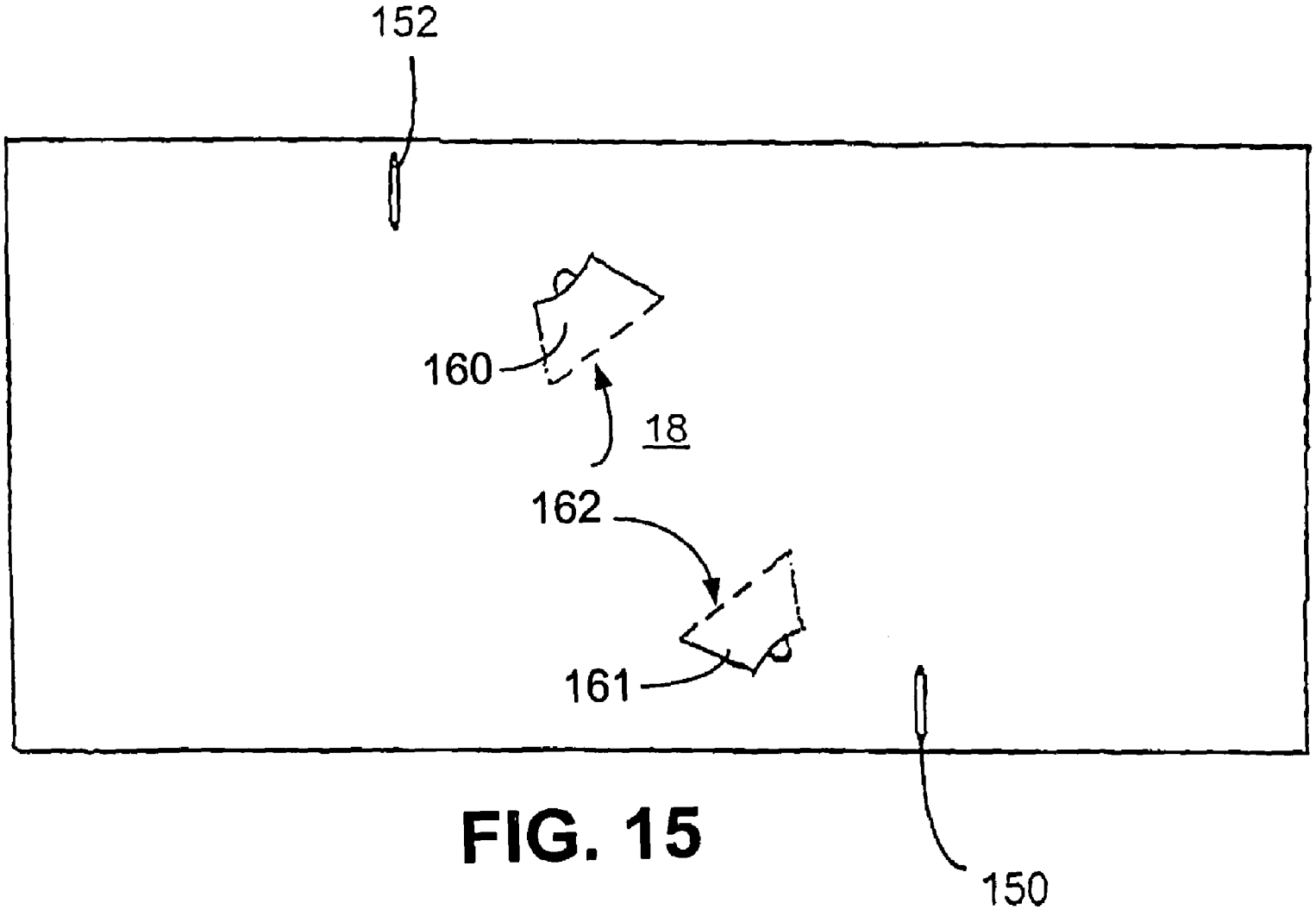
FIG. 15 is a bottom view of the carrier of FIG. 6 having pop-up tabs for securing cups within the chamber.

Another preferred alternate embodiment provides a pop-up tab for securing the bottom of the cup, as indicated in FIG. 15. In FIG. 15, the pop up tabs 160 and 161 for securing the cup may be of any shape. FIG. 15 represents a modification of FIG. 6 where the pop up tabs 160 and 161 are added. They may also be of any size, however in the preferred embodiment, the tab is small enough that the cutout from the base material of bottom 18 is not so large that it unduly weakens the structural support for the cup. The tab may be perforated, scored, or pinched along its fold line 162 to facilitate easier folding. Similarly, the fold line 162 may be comprised of two fold lines, parallel but slightly offset, or slightly off parallel, or curved, or otherwise non-single-linear so that the fold up operation is more difficult, meeting with downward resistance (i.e., pop-up tab 160 and 161 wants to fold back down to its flat state coplanar with bottom 18) so as to apply more compressive pressure against the cup. The pop-up tabs 160 and 161 permit the secure transport of cup in the chamber 36.

The invention may utilize a single pop-up tab, or a plurality of tabs. For example, in some applications it maybe advantageous to have two tabs, oriented roughly 90 degrees apart in plan view, and opposite the corners exterior and interior walls of the carrier, so as to tend to press the cup into the corner formed by the junction of the interior and exterior walls. Where there is only a single tab, in the preferred embodiment it will generally be advantageous to place the tab directly opposite (in plan view) of the same corner, so as to apply compressive pressure against that corner to maximally stabilize the cup. There may also be tabs at separate positions relative to the corner to accommodate cups of different sizes, specifically, of different base diameters. Thus, for smaller cups, the tabs closer to the corner will be used, and for larger cups, the tabs farther from the corner formed by walls will be used.

Figure 16:
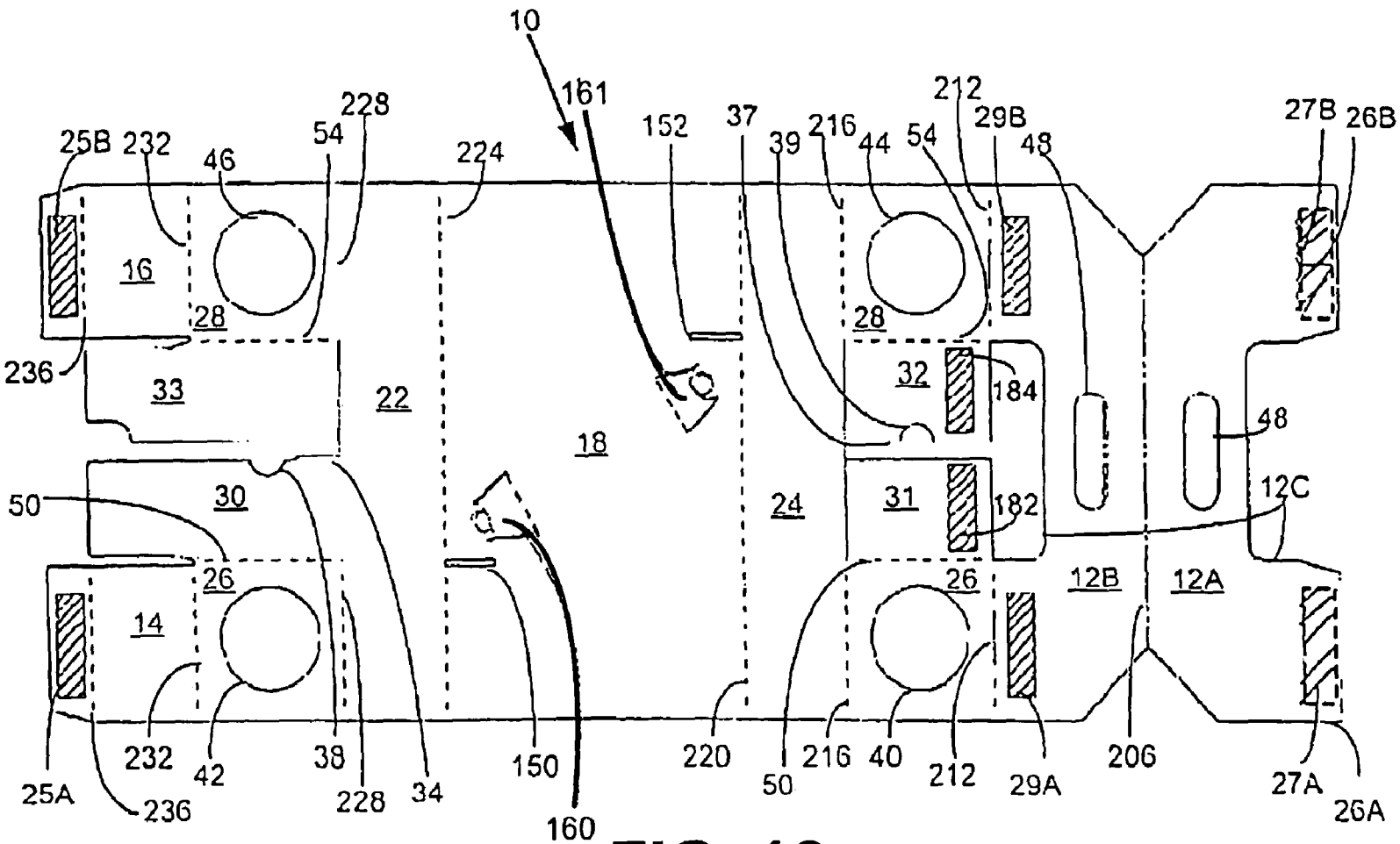
FIG. 16 is a top view of the single die-cut sheet of FIG. 1 having pop-up tabs for securing cups within the chamber.
Figure 17:
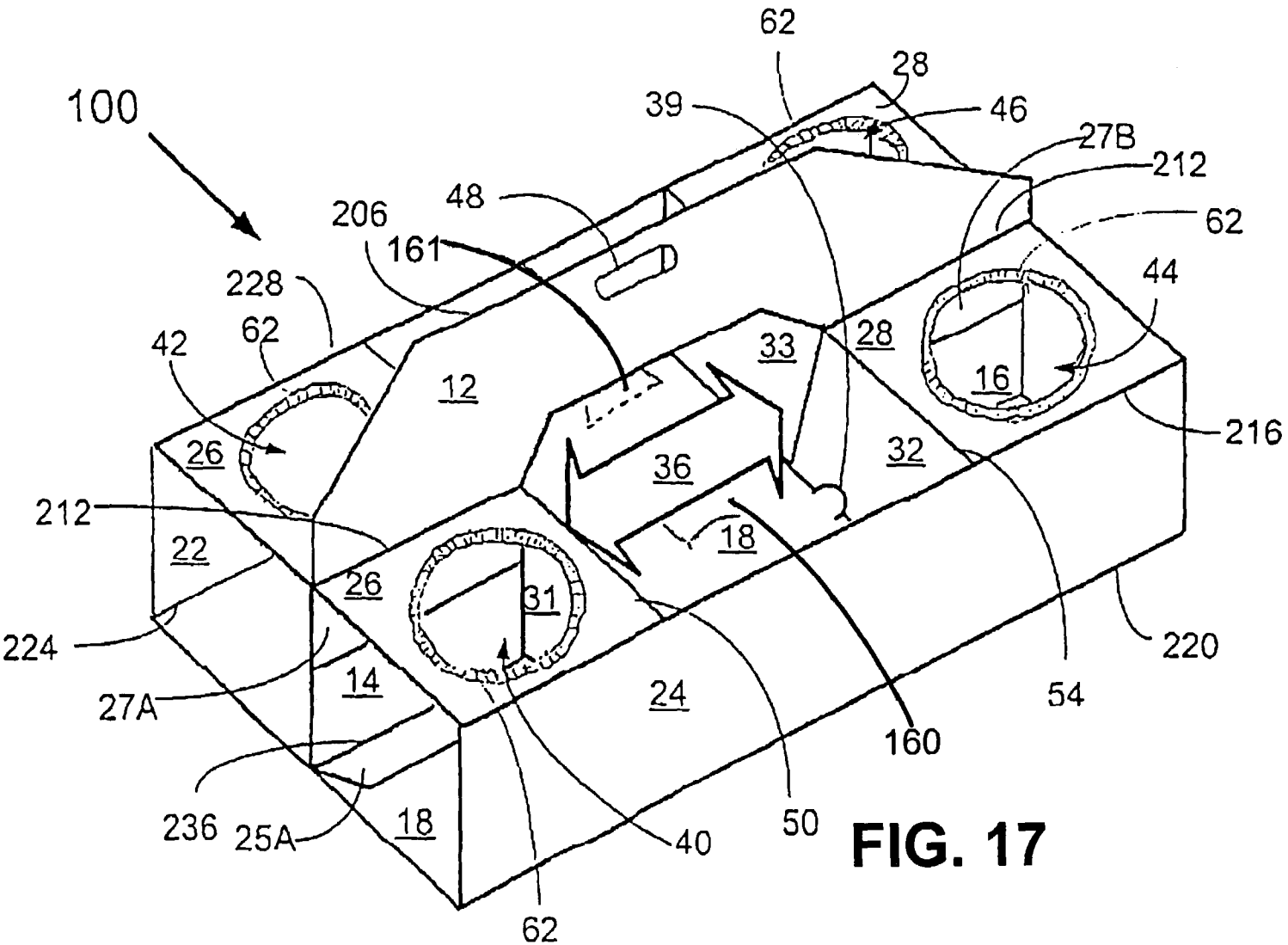
FIG. 17 is a perspective view of the alternate preferred embodiment of the expanded carrier of FIG. 5 having pop-up tabs within the chamber.

FIG. 16 is the same as FIG. 1, except that pop-up tabs 160 and 161 and finger-holes 150 and 152 have been added. Similarly, FIG. 17 is identical to FIG. 5 except that pop-up tabs 160 and 161 and finger-holes 150 and 152 have been added. The pop-up tabs 160 and 161 permit secure transport of cups within the chamber 36.

Accordingly, the scope of the invention is not limited by the disclosure of the preferred embodiments. For example, the horizontal and vertical surfaces of the expanded carrier need not be limited to printed text and images. Instead, its surfaces may be adapted to receive electronic displays, such as liquid crystal and light emitting diode display. The electronic display may be clipped onto the handle or carrier slides, or inserted between the slot pairs 432. These electronic displays may be preprogrammed to display messages and images, or alternatively receive wireless messages and images to be displayed. Furthermore, the surfaces may be affixed with bar codes or radio frequency identification tags to aid in inventory control of the carriers, or in the inventory control of the items transferred by the carriers. Another application of the invention is to function as a noisemaker. The carrier is inverted and the handle secured between the legs of a seated spectator such that the bottom of the carrier serves as a drum-like surface to beat upon. Another applications of the carrier is that printed messages on the carrier bottom serves as a slogan banner to be displayed by spectators. Instead, the invention should be determined entirely by reference to the claims that follow.

What is claimed is:

1. A multi-use carrier comprising:

a single die-cut sheet made of a flexible material having a first plurality of crease lines, a second plurality of crease lines, a handle cutout, a plurality of slots, a plurality of tabs, and a plurality of vessel apertures, whereby a first pivoting action applied to the first plurality of crease lines substantially erects the single die sheet to an expanded carrier having the handle cutout define a handle and the plurality of vessel apertures defined at least in part by a plurality of internal walls having a greater height than thickness disposed along the perimeter of the carrier, and a second pivoting action applied to the second plurality of crease lines engages the plurality of tabs with the plurality of slots to form an uncovered central chamber defined at least in part by the plurality of internal walls and accessible from above the carrier that is spanned by the handle and is surrounded by the plurality of vessel apertures.

2. The multi-use carrier of claim 1, wherein the plurality of apertures includes apertures having shapes that are substantially circular, oval, square, diamond, and X patterned.

3. The multi-use carrier of claim 2 wherein the plurality of apertures further includes groups of aperture shapes.

4. The multi-use carrier of claim 1, wherein the flexible material includes paper-based materials, plastic-based materials, and hybrid plastic and paper-based materials.

5. The multi-use carrier of claim 4, wherein the paper-based products include corrugated cardboard, the corrugated cardboard further including fluting grades A, B, C, E, F, and micro-fluting.

6. The multi-use carrier of claim 1, wherein the handle has surfaces for receiving a plurality of printed messages and images concerning food, beverage, gardening, janitorial, construction, microbiological, chemical, nuclear, business coupons, and recreational board game subject matters.

7. The multi-use carrier of claim 1, wherein the chamber includes a plurality of external walls having surfaces for receiving a plurality of printed messages and images concerning food, beverage, gardening, janitorial, construction, microbiological, chemical, nuclear, business coupons, and recreational board game subject matters.

8. The multi-use carrier of claim 1, wherein the chamber includes a plurality of internal walls having surfaces for receiving a plurality of printed messages and images concerning food, beverage, gardening, janitorial, construction, microbiological, chemical, nuclear, business coupons, and recreational board game subject matters.

9. The multi-use carrier of claim 1, wherein the expanded carrier includes a bottom having a surface for receiving a plurality of printed messages and images concerning food, beverage, gardening, janitorial, construction, microbiological, chemical, nuclear, business coupons, and recreational board game subject matters.

10. A single die sheet expandable into a multi-use carrier comprising:

a sheet of flexible material having a first plurality of crease lines, a second plurality of crease lines, a handle cutout, a plurality of slots, a plurality of tabs, and a plurality of vessel apertures, whereby a first pivoting action applied to the plurality set of crease lines substantially erects the single die sheet to an expanded carrier having the handle cutout define a handle and the plurality of vessel apertures defined in part by a plurality of internal walls having a greater height than thickness disposed along the perimeter of the carrier, and a second pivoting action applied to the second plurality of crease lines engages the plurality of tabs with the plurality of slots to form an uncovered central chamber defined at least in part by the plurality of internal walls and accessible from above the carrier that is spanned by the handle and is surrounded by the plurality of vessel apertures.

11. The single die sheet of claim 10, wherein the plurality of apertures includes apertures having shapes that are substantially circular, oval, square, diamond, and X patterned.

12. The single die sheet of claim 11, wherein the plurality of apertures further includes groups of aperture shapes.

13. The single die sheet of claim 10, wherein the flexible material includes corrugated cardboard selected from group consisting of fluting grades A, B, C, E, F, and micro-fluting.

14. The single die sheet of claim 10, wherein the handle has surfaces for receiving a plurality of printed messages and images concerning food, beverage, gardening, janitorial, construction, microbiological, chemical, nuclear, business coupons, and recreational board game subject matters.

15. The single die sheet of claim 10, wherein the plurality of external walls has surfaces for receiving a plurality of printed messages and images concerning food, beverage, gardening, janitorial, construction, microbiological, chemical, nuclear, business coupons, and recreational board game subject matters.

16. The single die sheet of claim 10, wherein the expanded carrier is approximately 11⅛ inches long, 7½ inches wide, approximately 2⅛ inches high as determined by the height of the external walls of the chamber, and includes the central chamber having a length of approximately 7⅛ inches, a width of approximately 3⅛ inches, and a height of approximately 2 inches as determined by the height of the internal walls of the chamber.

17. The single die sheet of claim 10, wherein the expanded carrier is approximately 15½ inches long, 9 inches wide, approximately 2⅛ inches high as determined by the height of the external walls of the chamber, and includes the central chamber having a length of approximately 8⅝ inches, a width of approximately 6½ inches, and a height of approximately 2 inches as determined by the height of the internal walls of the chamber.

18. A multi-use carrier comprising:

a collapsed carrier substantially folded into approximately three layers, the collapsed carrier made from a plurality of nonflexible panels, the collapsed carrier including:

a handle;

a first plurality of hinges connecting the nonflexible panels;

a bottom having a plurality of slots;

a plurality of exterior walls;

a first plurality of interior walls having a height greater than a thickness of the walls;

a second plurality of interior walls, the second plurality of interior walls having tabs and a second plurality of hinges and a height greater than a thickness of the walls; and a plurality of vessel apertures, such that a first pivoting action applied to the first plurality of hinges followed by a second pivoting action applied to the second plurality of hinges pivots the interior walls and inserts the tabs into the slots and transforms the collapsed carrier into an expanded carrier wherein the handle spans across an uncovered central chamber defined at least in part by the plurality of internal walls and accessible from above the carrier and the central chamber is surrounded by the plurality of vessel apertures, the apertures defined at least in part by the plurality of internal walls.

19. The multi-use carrier of claim 18, wherein the nonflexible panels are made from metals, woods, plastics, fiberglass, hard pressed fiber papers and any combination of metals, woods, plastics, fiberglass and hard pressed fiber papers.

20. The multi-use carrier of claim 19, wherein the surfaces of the nonflexible panels are configured for receiving a plurality of printed messages and images concerning food, beverage, gardening, janitorial, construction, microbiological, chemical, nuclear, business promotion, and recreational board game subject matters.

* * * * *